US012668919B1

(12) United States Patent
Miller, III et al.

(10) Patent No.: US 12,668,919 B1
(45) Date of Patent: Jun. 30, 2026

(54) SYSTEM AND METHOD FOR FIBER CLEANING, ALIGNMENT, AND SIZING

(71) Applicant: Bastcore, Inc., Homewood, AL (US)

(72) Inventors: Robert A. Miller, III, New Ringgold, PA (US); Bibb Coleman Beale, III, Montgomery, AL (US); John G. Brown, Verbena, AL (US); Larry T. Sneed, Equality, AL (US)

( * ) Notice: Subject to any disclaimer, the term of this patent is extended or adjusted under 35 U.S.C. 154(b) by 0 days.

(21) Appl. No.: 18/888,364

(22) Filed: Sep. 18, 2024

(51) Int. Cl.

| | |
|---|---|
| ***D21B 1/06*** | (2006.01) |
| ***D01G 15/04*** | (2006.01) |
| ***D01G 15/20*** | (2006.01) |
| ***D01G 15/26*** | (2006.01) |
| ***D21D 5/04*** | (2006.01) |

(52) U.S. Cl.
CPC ..... *D21B 1/061* (2013.01); *D01G 15/04* (2013.01); *D01G 15/20* (2013.01); *D01G 15/26* (2013.01); *D21B 1/063* (2013.01); *D21D 5/043* (2013.01)

(58) Field of Classification Search
CPC ... D01B 1/14; D01B 1/04; D01B 9/04; D01B 9/06; D21B 1/025; D21B 1/061; D21B 1/063; D21D 1/32; D21D 5/043
See application file for complete search history.

(56) References Cited

U.S. PATENT DOCUMENTS

| | | | | |
|---|---|---|---|---|
| 2,957,209 | A * | 10/1960 | Schulze | D01B 1/14 19/9 |
| 5,513,805 | A * | 5/1996 | Fisher | B07B 1/20 241/73 |
| 6,079,647 | A * | 6/2000 | Leduc | D01B 1/22 241/73 |
| 2008/0289149 | A1* | 11/2008 | Chute | D01B 1/14 19/24 |
| 2012/0324677 | A1* | 12/2012 | Hao | D01C 1/02 19/115 R |
| 2015/0166745 | A1* | 6/2015 | Henry | D01B 1/00 19/205 |
| 2020/0398285 | A1* | 12/2020 | Pildysh | D01B 1/22 |
| 2021/0189597 | A1* | 6/2021 | Czinner | C08L 97/02 |
| 2024/0035202 | A1* | 2/2024 | Pires | D01B 1/40 |

* cited by examiner

*Primary Examiner* — Aiying Zhao
(74) *Attorney, Agent, or Firm* — AdamsIP, LLC; Stephen Thompson; J. Hunter Adams

(57) ABSTRACT

A mechanical system and a method of using the system for separating and refining plant fibers are provided. The plant fibers are separated into a bast fiber stream and a hurd stream, each of which may be processed separately to produce a finished bast fiber product and a finished hurd product. The bast fiber stream is processed through a series of unit operations including a chopper assembly, a shredder assembly, a coarse cleaner assembly, a fine cleaner assembly, and a carding machine. The hurd stream may be further processed through a hammer mill and a vibrating sieve.

17 Claims, 15 Drawing Sheets

SYSTEM AND METHOD FOR FIBER CLEANING, ALIGNMENT, AND SIZING

FIELD OF THE INVENTION

The present disclosure relates generally to a mechanical system and a method of using the system for separating and refining plant fibers.

BACKGROUND

Certain dicotyledonous plants, including examples such as hemp (*Cannabis stiva*), jute (Corchorus sp.), and kenaf (*Hibiscus cannabinus*), have woody stalks containing two main types of fiber useful for processing into various cellulosic products including, but not limited to, textiles, twine, rope, cordage, yarns, sorbents, pet bedding, and other similar products. These fiber types are longer fibrovascular bundle phloem fibers ("bast") located between the epidermis and inner woody core and short fibers contained in the core or stem of the plant ("hurd"). Phloem fibers are constituted from bundles of tube-like cell walls of various layers that may be much longer than the wood fibers. Phloem fibers also have higher crystalline cellulosic content, which makes them desirable for industrial processes.

These fibers may be produced through biochemical processes, including retting and enzymatic treatment, which results in an overall degradation and loss of hemicellulose, pectin, and lignin of the short hurd fiber making it less desirable for some uses. Fibers may also be produced through manual or mechanical decortication causing the release of fiber bundles. Decortication processes typically comprise a series of unit operations performed on one or more dicotyledonous plant stalks by various mechanical apparatus for primary recovery of the fibers through destruction of the stem or plant part containing the fiber. Such operations generally include: breaking, decortication, and cleaning. Primary separation of the bast from the hurd is typically done by a series of mechanical operations through imposing stress on the plant stalk through squeezing and breaking. Stresses imposed on the fiber through this process create conditions that may lead to breaking of fiber, low yield due to misalignment of the fiber in the apparatus, hurd contamination, and inefficient separation of the phloem.

After decortication, the hurd and bast fibers must be sorted into separate streams and then cleaned and sized for appropriate end uses. The bast fiber must be free of hurd, and the hurd must be free of bast fiber. The bast fibers are typically processed further through a carding system, which is generally used to disentangle and align the bast fibers. However, industrial systems currently used commercially for such processing of fibers typically leave behind many impurities within the fiber, making the fiber more difficult to work with and thus less suitable for textile applications.

SUMMARY

In one aspect, a system and method of processing and refining plant fibers are provided. The method comprises first decorticating plant stalks to separate bast fibers from hurd. The method may be utilized with hemp, jute, or kenaf plant stalks, or any other suitable type of plant stalk having an inner woody core surrounded by bast fibers. After decortication, the bast fibers and hurd are physically separated to a large extent but are still mixed together in a combined mass. The bast fibers and the hurd are then separated into separate process streams comprising a bast fiber stream and a hurd stream. This step may be performed by a vibrating sizing screen having openings sized to separate the bast fibers from the hurd. At this first stage of separation, however, the bast fiber stream still contains an amount of hurd, and the hurd stream still contains an amount of bast fibers. Both streams also contain a variety of other impurities, such as dirt and other debris, that need to be removed from each of the streams. Each stream may then be processed separately to produce usable products of cleaned and refined bast fibers and hurd.

After separating into separate process streams, the bast fiber stream is then routed to a chopper assembly that is configured to cut the bast fibers using a blade to reduce the average length of the bast fibers. The bast fibers of reduced length are then routed to a shredder assembly. The shredder assembly comprises a shredding roller configured to rotate about an axis of rotation and a bed disposed below the shredding roller. The shredding roller comprises a plurality of pins extending radially outward from the shredding roller and is configured such that the plurality of pins contacts the bast fibers on the bed when the shredding roller rotates, thereby combing the bast fibers and conveying the bast fibers along the bed. The combing action of the pins of the shredding roller helps to open the fiber bundle of the bast fibers while also helping to align the bast fibers by causing the bast fibers to become arranged in an orientation that is parallel to other fibers and parallel to a flow direction of the bast fiber stream. The combing action also helps to further separate hurd material from the bast fibers.

The bast fiber stream may then be routed to a coarse cleaner assembly and then to a fine cleaner assembly. The coarse cleaner assembly is generally configured to remove larger, coarse impurities from the bast fiber stream, and the fine cleaner assembly is generally configured to remove smaller, finer impurities from the bast fiber stream. The coarse cleaner assembly comprises a rotating drum configured to rotate about an axis of rotation and a bed disposed below the rotating drum. The bed below the rotating drum has a plurality of bed openings extending through the bed. The rotating drum comprises a plurality of beater bars extending radially outward from the rotating drum, and the rotating drum is configured such that the plurality of beater bars contacts the bast fibers on the bed when the rotating drum rotates, thereby causing larger impurities to separate from the bast fibers and fall through the plurality of bed openings in the bed. The bast fiber stream may then be routed to a fine cleaner assembly comprising a cleaning roller configured to rotate about an axis of rotation and having a plurality of teeth extending radially outward from the cleaning roller. The cleaning roller is configured such that the plurality of teeth contacts the bast fibers when the cleaning roller rotates, thereby causing smaller impurities to separate from the bast fibers.

After processing the bast fiber stream through the coarse and fine cleaner assemblies, the stream is then routed through a carding machine comprising a carding drum and at least one working roller. The carding machine further refines and finishes the bast fiber stream to produce the final bast fiber product. The hurd stream may be processed separately from the bast fiber stream by routing the hurd stream to a hammer mill and then to a vibrating sieve configured to separate the hurd from impurities contained in the hurd stream and optionally to sort the hurd material according to size. The present system and method are capable of producing bast fiber and hurd from which 99% of all impurities have been removed. Further, the present system and method are capable of producing bast fiber and hurd that are properly sized for yarn spinning of woven fabrics, such as wool or cotton, or nonwoven fabrics. The present system and method comprise unit operations and method steps that are entirely mechanical processes that do not use any chemicals for decortication, cleaning, or any other steps.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DESCRIPTION OF THE DRAWINGS

These and other features, aspects, and advantages of the present invention will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1A:
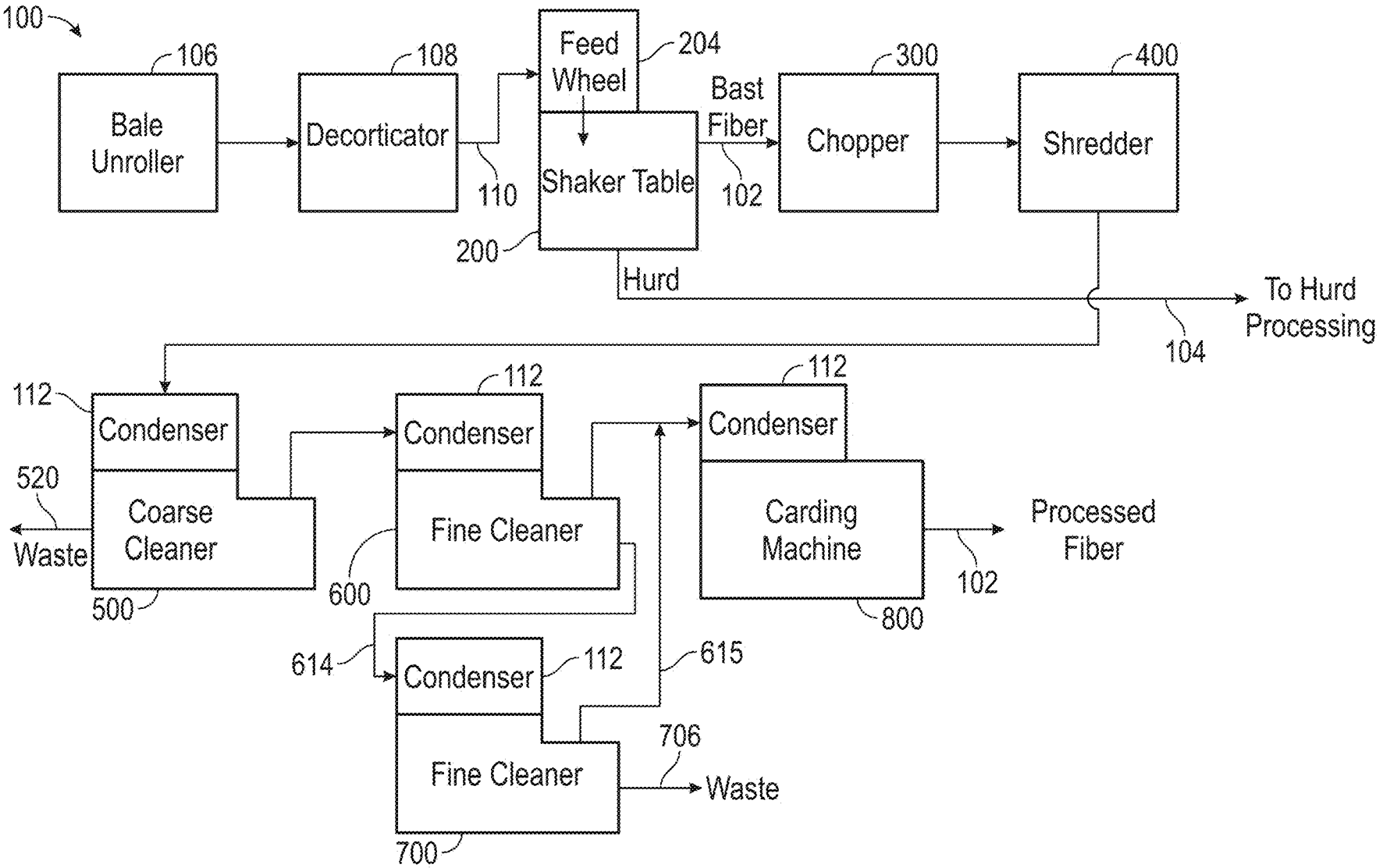
FIG. 1A shows a process flow diagram of a method of processing bast fibers in accordance with the present disclosure.
Figure 1B:
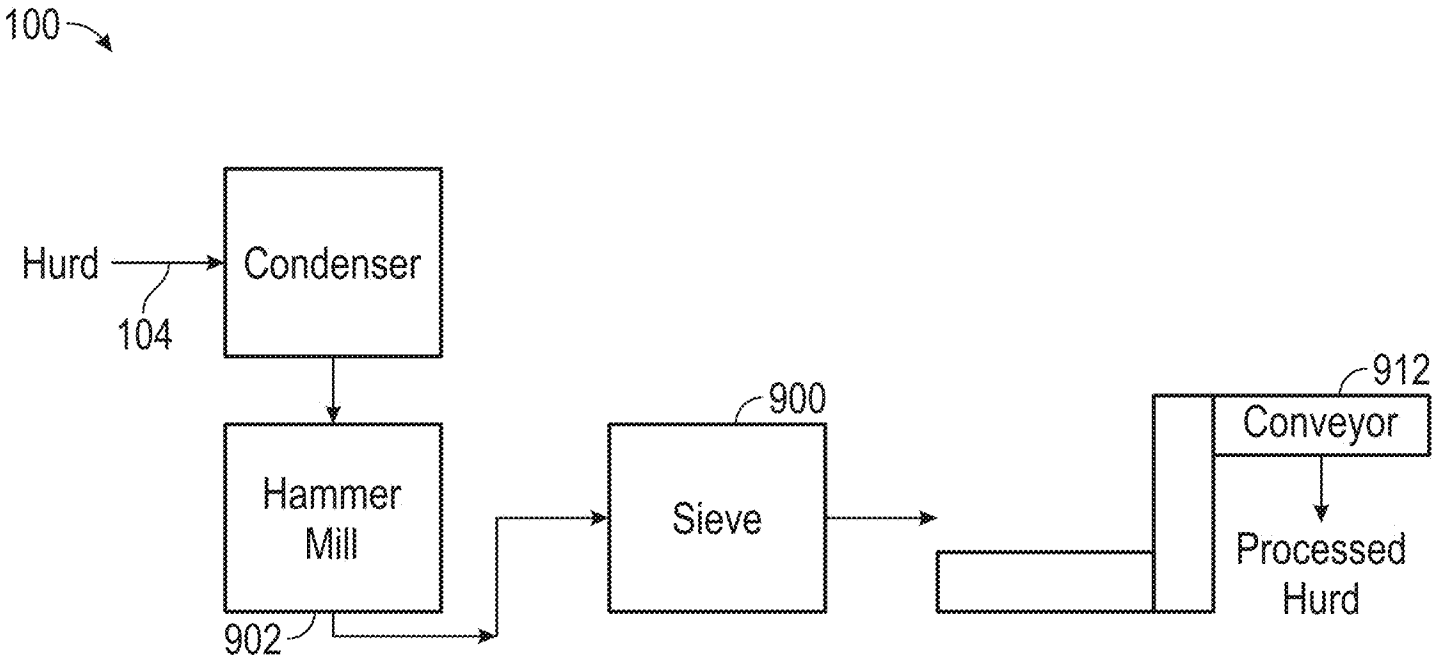
FIG. 1B shows a process flow diagram of a method of processing hurd fibers in accordance with the present disclosure.

In one aspect, a system 100 and method of processing and refining plant fibers are provided. FIGS. 1A and 1B show a process flow diagram of the system 100 and method. FIG. 1A shows unit operations and method steps before separating decorticated plant stalks into separate process streams comprising a bast fiber stream 102 and a hurd stream 104 and unit operations and method steps for processing the bast fiber stream 102. FIG. 1B shows unit operations and method steps for processing the hurd stream 104. FIGS. 2-13 illustrate particular unit operations or components thereof for carrying out the present method for separating and refining plant fibers. The present system 100 and method comprise unit operations and method steps that are entirely mechanical processes that do not use any chemicals in any of the steps of the process.

Plant stalks are typically baled for transportation to a processing facility. The present system 100 may optionally include a bale unroller 106 configured to unroll a bale of plant stalks and feed the plant stalks to a decorticator 108. Any commercially available bale unroller 106 suitable for unrolling bales of plant stalks may be utilized. Alternatively, the plant stalks may be transported unbaled and fed to the decorticator 108 in any other suitable manner. The unrolled plant stalks are then routed to the decorticator 108 for stripping the bast fiber and woody core from the vascular tissue of the plant stalks. In a preferred embodiment, the decorticator disclosed in U.S. Pat. No. 11,519,099, which is hereby incorporated herein in its entirety by reference, may be utilized. Alternatively, any commercially available decorticator 108 suitable for separating the bast and hurd fibers may be utilized. The decorticator 108 is preferably fully automatic. The decorticator 108 may be utilized to decorticate hemp, jute, or kenaf plant stalks, or any other suitable type of plant stalk having an inner woody core surrounded by bast fibers.

Figure 2:
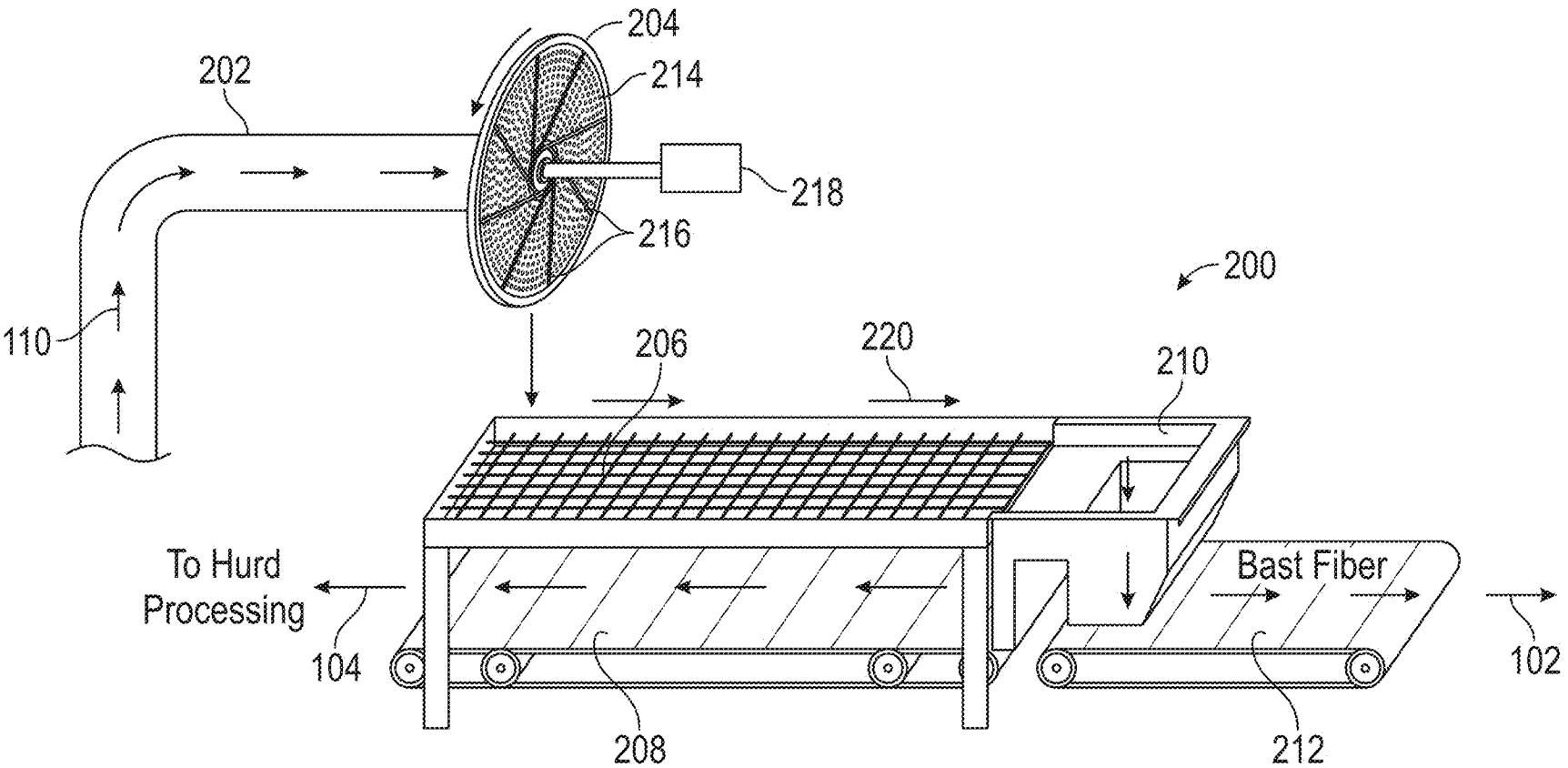
FIG. 2 shows a schematic diagram of a system for separating bast and hurd fibers in accordance with the present disclosure.

After being processed through the decorticator 108, a combined stream 110 includes both the bast fibers and the hurd, which are physically separated to a large extent but are still mixed together in the combined stream 110 and thus require further separation. The bast fibers and the hurd are then separated into the separate process streams including the bast fiber stream 102 and the hurd stream 104. In a preferred embodiment, the system 100 comprises a shaker table assembly 200 disposed downstream of the decorticator 108 and configured to separate the combined stream 110 into the bast fiber stream 102 and the hurd stream 104. The combined stream 110 may be conveyed pneumatically from the decorticator 108 to the shaker table assembly 200 through a large pipe 202 or other type of conduit using a blower. To remove the contents of the combined stream 110 from the air stream, the system 100 may include a feed wheel 204 configured to direct the contents of the combined stream 110 onto the shaker table 200, as shown in FIG. 2. The feed wheel 204 is configured to rotate, and rotation is driven by a motor 218 operatively connected to the wheel 204. The feed wheel 204 preferably comprises a screen 214 and a plurality of vanes 216 disposed on at least the side of the screen 214 facing the airflow. The screen 214 has a plurality of small openings that extend through the screen 214, and the openings are sized to allow air to pass through the screen 214 but to prevent the bulk of the plant material making up the combined stream 110 from passing through the screen 214. An outlet end of conduit 202 may be disposed directly adjacent to the screen 214 so that the vanes 216, which are preferably constructed of a flexible material such as rubber, contact the outlet end of the conduit 202 and force the material of the combined stream 110 downward onto the shaker table 200 as the wheel 204 rotates while the air passes through the screen 214. Alternatively, other devices or mechanisms suitable for feeding the combined stream 110 onto the shaker table 200 for separation may be utilized.

The shaker table assembly 200 may then be utilized to separate the bast fibers from the hurd fibers. The shaker table assembly 200 comprises a vibrating sizing screen 206 having a plurality of openings sized to allow a majority of the hurd to fall through the openings of the vibrating screen 206 while a majority of the bast fibers do not fall through the screen 206 but remain on a top side of the screen 206, thereby separating most of the bast fibers from the hurd. However, after separation of the bast and hurd fibers using the vibrating screen 206, the bast fiber stream 102 still contains an amount of hurd material, and the hurd stream 104 still contains an amount of bast fibers. Both streams 102 and 104 also contain a variety of other impurities, including dirt and debris. Each of the streams 102 and 104 may then be processed separately to produce usable products of cleaned and refined bast fibers and hurd. In a preferred embodiment, the shaker table assembly 200 further comprises a hurd conveyor 208 disposed below the vibrating screen 206. The hurd conveyor 208 is configured to collect the hurd material that falls through the openings in the vibrating screen 206 and then convey the hurd to unit operations for hurd processing, as shown in FIGS. 1A and 1B.

A motor may be utilized to drive vibration of the screen 206, which may generally cause the bast fibers disposed on the top side of the screen 206 to move in a conveyance direction 220 toward a hopper 210 disposed at an end of the vibrating screen 206 opposite an end at which the feed wheel 204 directs the material of the combined stream 110 onto the vibrating screen 206. A user may optionally manually move some or all of the bast fibers in the conveyance direction 220 and into the hopper 210 to speed up the processing of the bast fibers. As the best fibers move on the vibrating screen 206 in the conveyance direction 220, hurd may be continuously separated from the bast fibers and fall onto the hurd conveyor 208. The shaker table assembly 200 may further comprise a bast fiber conveyor 212 disposed under the hopper 210 and configured to convey the bast fiber stream 102 to the next unit operation. Alternatively, other devices or mechanisms other than a vibrating screen 206 that are suitable for mechanically separating the combined stream 110 into a bast fiber stream 102 and a hurd stream 104 may be utilized and still fall within the scope of the present disclosure.

Figure 3:
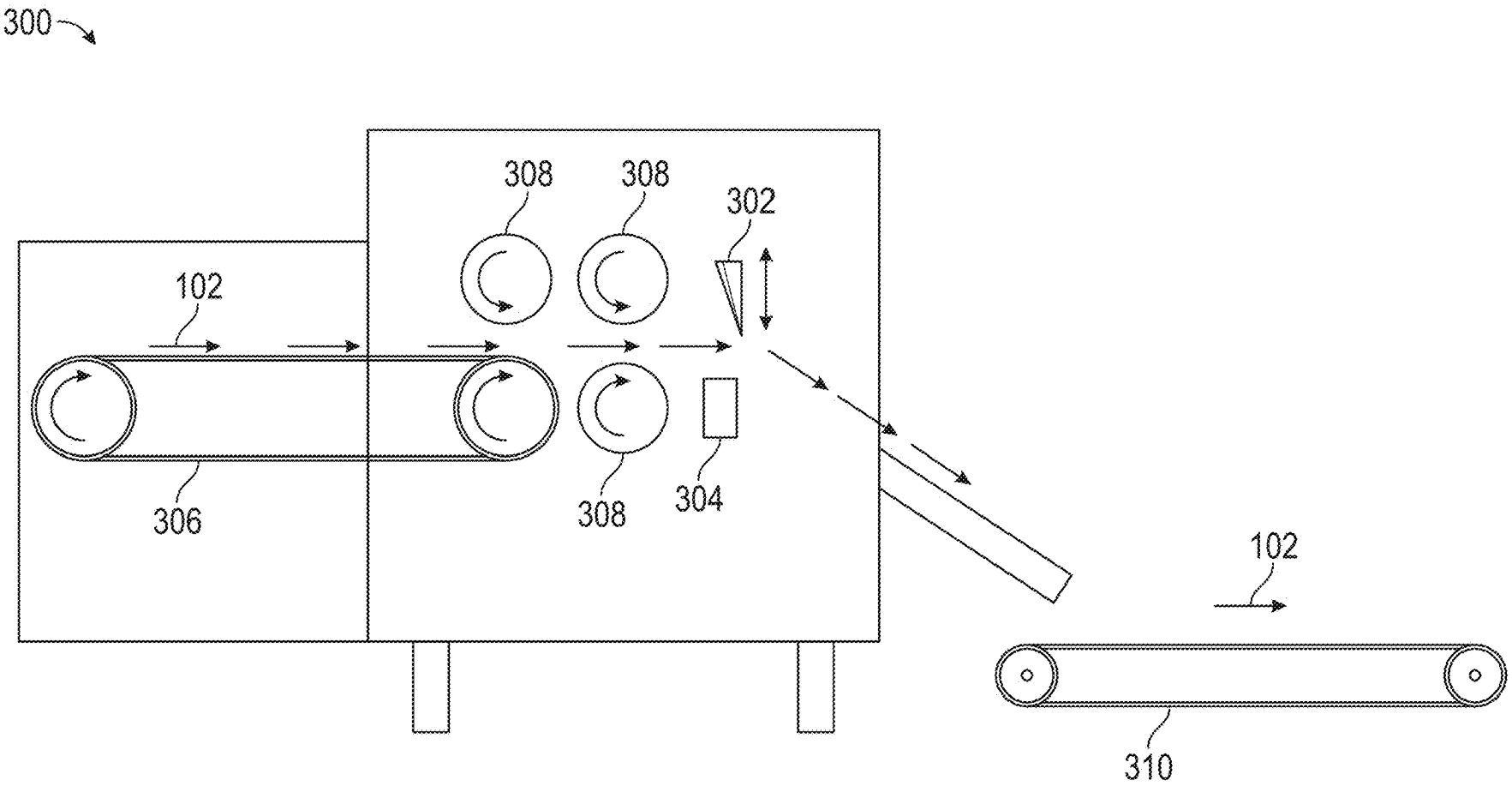
FIG. 3 shows a schematic diagram of a system for chopping bast fibers in accordance with the present disclosure.

After separating the common stream 110 into a separate bast fiber stream 102 and hurd stream 104, the bast fiber stream 102 is then routed to a chopper assembly 300, as shown in FIG. 3. Because bast fibers are generally naturally long fibers, chopper assembly 300 is configured to cut the bast fibers using a blade 302 to reduce the average length of the bast fibers. The blade 302 is preferably a reciprocating blade 302 that moves up and down and may be powered by a reciprocating electric motor. The reciprocating blade 302 may be disposed above an anvil 304 to facilitate chopping the bast fibers. The chopper assembly 300 may comprise a feed conveyor 306 that feeds the bast fiber stream 102 from conveyor 212 to the chopping blade 302. The chopper assembly 300 may further comprise a set of feed rollers 308 configured to convey the bast fibers from the feed conveyor 306 to the reciprocating blade 302. Each of the feed rollers 308 preferably has a fluted outer surface. The average length of the bast fibers in the bast fiber stream 102 after length reduction may be determined by the feed rate of the bast fiber stream 102, which may be controlled by adjusting the speed of rotation of the feed rollers 308, and the speed of the reciprocating blade 302. The chopper assembly 300 may further comprise a discharge conveyor 310 configured to convey the bast fiber stream 102 from the chopper assembly 300 to the next unit operation.

Figure 4:
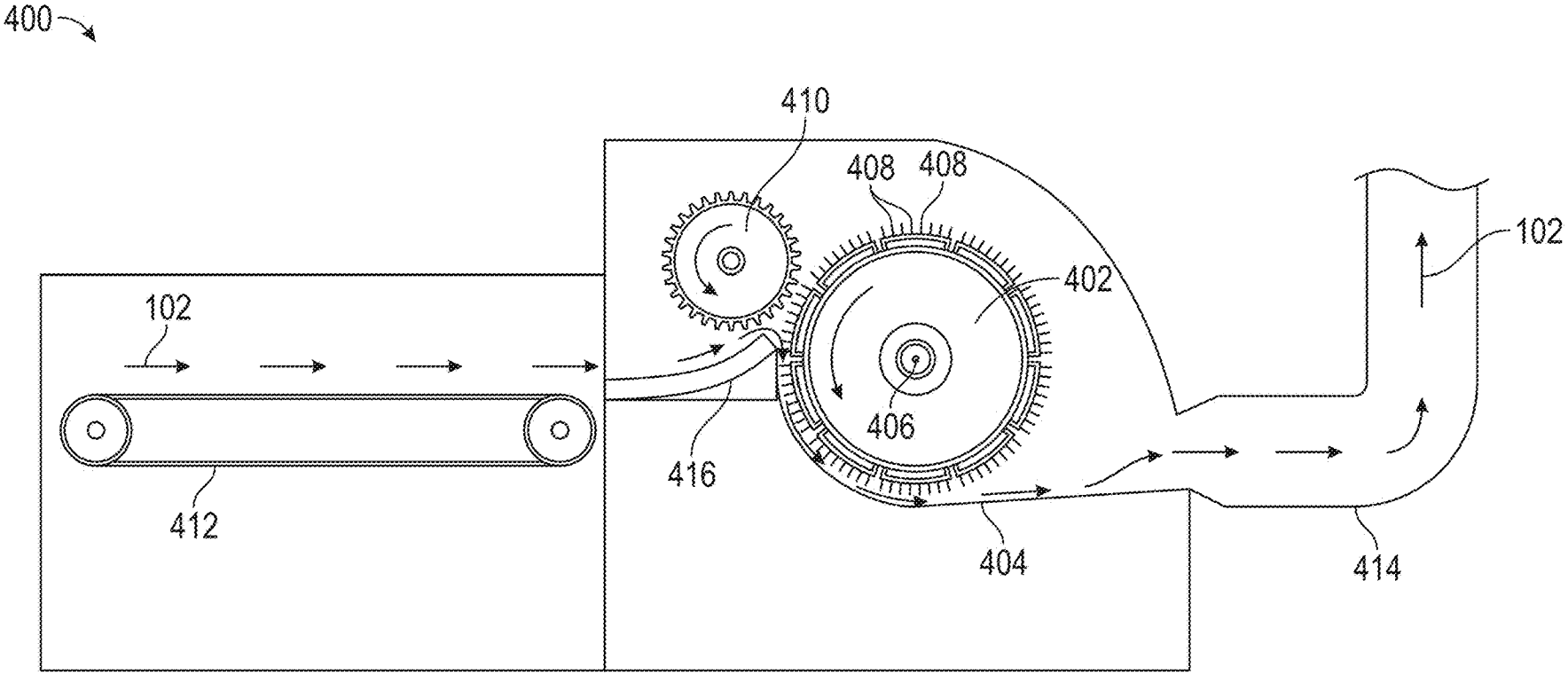
FIG. 4 shows a schematic diagram of a system for shredding bast fibers in accordance with the present disclosure.

The bast fiber stream 102 containing bast fibers of reduced length is then routed to a shredder assembly 400, as shown in FIG. 4. The shredder assembly 400 is disposed downstream of the chopper assembly 300. The shredder assembly 400 comprises a shredding roller 402 configured to rotate about an axis of rotation 406 and a bed 404 disposed below the shredding roller 402. The shredding roller 402 comprises a plurality of pins 408 extending radially outward from an outer surface of the shredding roller 402. The shredder assembly 400 preferably includes a feed roller 410 having a plurality of serrated teeth disposed around an outer surface of the feed roller 410. The shredder assembly 400 may comprise a feed conveyor 412 that feeds the bast fiber stream 102 from the conveyor 310 to the shredding roller 402. The feed roller 410 may rotate such that the teeth on the exterior of the feed roller 410 engage with the bast fibers and transfer the bast fibers to the shredding roller 402. The shredding roller 402 is preferably in close proximity to the feed roller 410 so that distal ends of each of the pins 408 on the shredding roller 402 pass near distal ends of the teeth on the feed roller 410 and engage with the bast fibers and pull the fibers off of the feed roller 410 as the shredding roller 402 rotates. The feed roller 410 and shredding roller 402 may rotate in the same rotational direction, which is a counterclockwise direction as viewed from the perspective shown in FIG. 4. The shredder assembly 400 may include a curved or ramped surface 416 disposed below the feed roller 410. The ramped surface 416 may have a shape that generally conforms to the curvature of the feed roller 410 so that the bast fibers are efficiently transferred from the feed roller 410 to the shredding roller 402. A downstream end of the ramped surface 416 may then transition to a generally vertical surface that forms an upstream portion of the bed 404. The shredding roller 402 preferably rotates at a faster rotational speed that the rotational speed of the feed roller 410 so that the shredding roller 402 efficiently pulls the bast fibers off of the feed roller 410 at a controlled rate so that the bast fibers are evenly dispersed without excess clumping of bast fibers.

Figure 10:
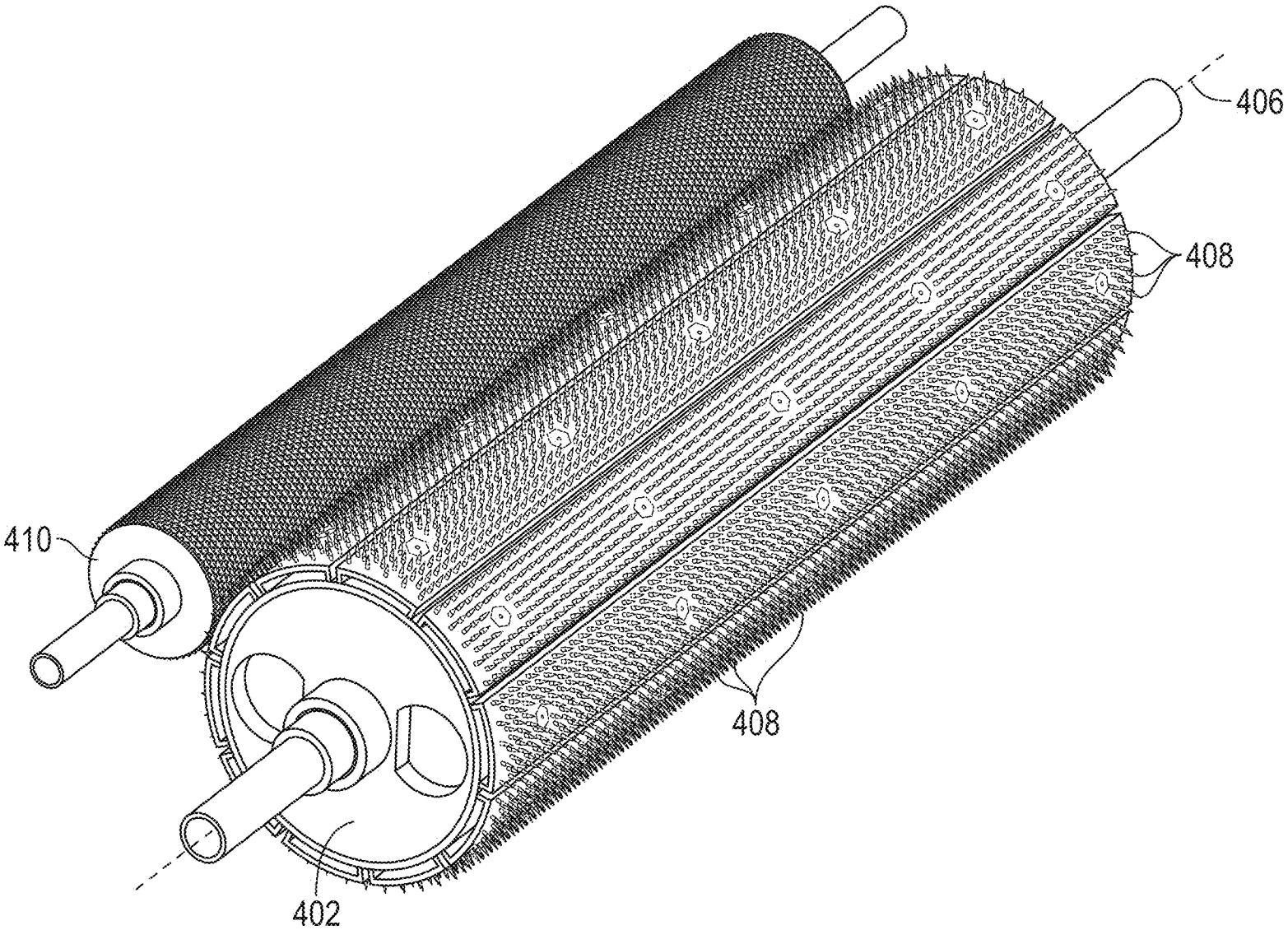
FIG. 10 shows a perspective view of components of a system for shredding bast fibers in accordance with the present disclosure.

The shredding roller 402 is configured such that the plurality of pins 408 contacts the bast fibers on the bed 404 when the shredding roller 402 rotates, thereby combing the bast fibers and conveying the bast fibers along the bed 404. The bed 404 may have a surface for which at least a portion of the surface of the bed 404 has a shape that generally conforms to the curvature of the shredding roller 402 so that the shredding roller 402 can efficiently convey the bast fibers along the surface of the bed 404. In a preferred embodiment, there is a clearance of about 4-8 inches, and preferably about 6 inches, between the curved portion of the bed 404 and distal ends of the pins 408 as the shredding roller 402 rotates. As shown in FIG. 4, the curved portion of the bed 404 is generally on an upstream end of the bed 404, and the bed 404 preferably transitions to a straight portion on a downstream end of the bed 404 relative to the shredding roller 402. FIG. 10 shows a perspective view of both the feed roller 410 and the shredding roller 402 removed from the shredder assembly 400. The plurality of pins 408 on the shredding roller 402 may be arranged in linear rows that are generally parallel to the axis of rotation 406 of the shredding roller 402. In a preferred embodiment, there are at least 10,000 individual pins 408 attached to the shredding roller 402. In one preferred embodiment, each pin 408 has a height of about 7-8 millimeters (mm) from the outer surface of the shredding roller 402 to a distal end of the pin 408 and a diameter of approximately 4 mm, and each pin 408 is approximately 6 mm apart from each adjacent pin 408. Each pin 408 preferably has a cylindrical body that tapers to a sharp point at the distal end of the pin 408. As the shredding roller 402 rotates about axis 406, the pins 408 comb the bast fibers, which are contacting the bed 404, and convey the bast fibers along the upper surface of the bed 404. When the bast fiber stream 102 is conveyed from the chopper assembly 300 to the shredder assembly 400, much of the bast fibers are typically in tangled wads of fiber material. The combing action of the pins 408 pulls the fibers apart and helps to open the fiber bundle of the bast fibers while also helping to align the bast fibers by causing the bast fibers to become arranged in an orientation that is parallel to other fibers and parallel to a flow direction of the bast fiber stream 102 as the bast fibers are conveyed by the shredding roller 402 along the curved portion of the bed 404 to the straight portion of the bed 404 and then to a discharge point. The combing action also helps to further separate any remaining hurd material from the bast fibers. The bast fiber stream 102 may then be pneumatically conveyed through conduit 414 from the shredder assembly 400 to the next unit operation. A suction blower 118 upstream of the next unit operation may be used to provide suction for pneumatic conveyance through conduit 414.

Figure 5:
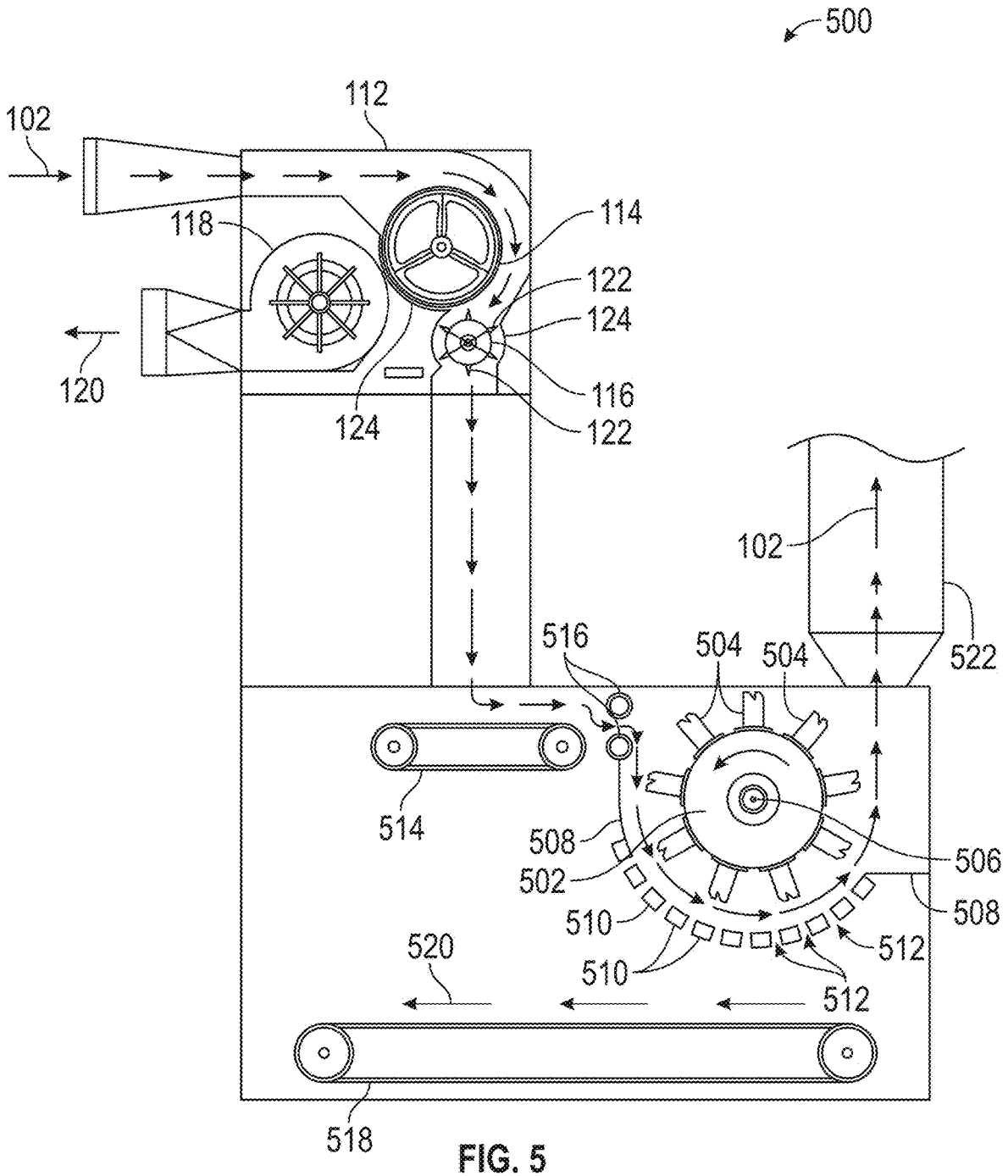
FIG. 5 shows a schematic diagram of a system for condensing and cleaning bast fibers in accordance with the present disclosure.
Figure 6:
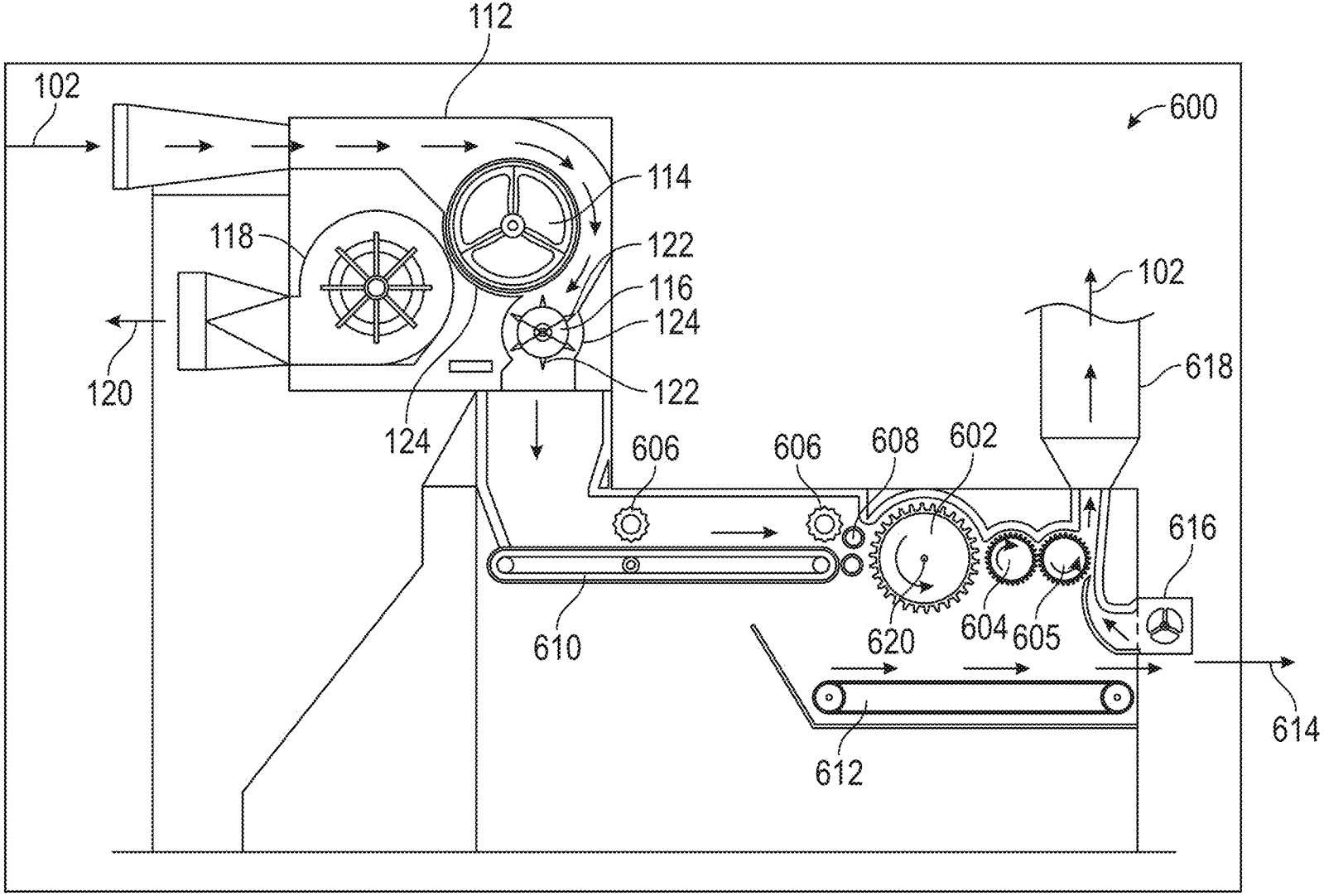
FIG. 6 shows a schematic diagram of a system for condensing and cleaning bast fibers in accordance with the present disclosure.
Figure 7:
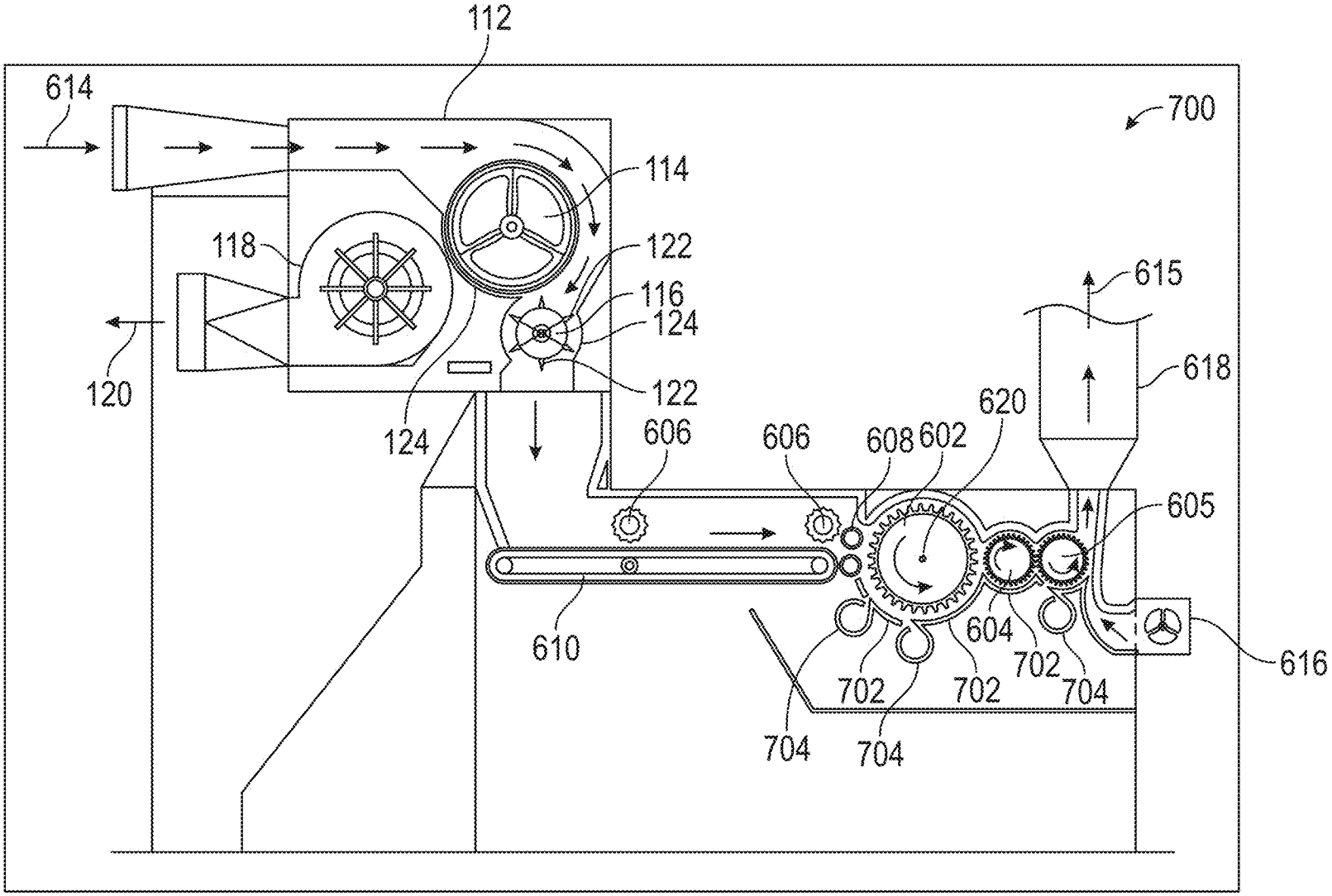
FIG. 7 shows a schematic diagram of a system for condensing and cleaning bast fibers in accordance with the present disclosure.

The bast fiber stream 102 may then be routed to a coarse cleaner assembly 500 and then to a fine cleaner assembly 600. The coarse cleaner assembly 500 is downstream of the shredder assembly 400, and the fine cleaner assembly 600 is preferably downstream of the coarse cleaner assembly 500. In a preferred embodiment, the system 100 may optionally include a second fine cleaner assembly 700 downstream of the first fine cleaner assembly 600. The coarse cleaner assembly 500 is generally configured to remove larger, coarse impurities and waste material, including hurd material, from the bast fiber stream 102, and the fine cleaner assemblies 600 and 700 are generally configured to remove smaller, finer impurities and waste material from the bast fiber stream 102. FIG. 5 illustrates the coarse cleaner assembly 500, and FIGS. 6 and 7 illustrate the first fine cleaner assembly 600 and second fine cleaner assembly 700, respectively. Both the larger and smaller impurities may include a variety of different types of impurities that may vary in size, including, but not limited to, particles of dirt or other debris, fines, other types of particulate matter, hurd material contained in the bast fiber stream 102, bast fibers contained in the hurd stream 104, or any other type of contaminant or other waste material that may be present in either stream 102 or 104. These impurities may range in size from micro-dust up to impurities that are several inches in size.

In a preferred embodiment, when the bast fiber stream 102 is discharged from the shredder assembly 400, the bast fibers are conveyed pneumatically to each of the downstream unit operations. In this embodiment, each of the downstream unit operations, including the coarse cleaner assembly 500 and each of the fine cleaner assemblies 600 and 700, may comprise a condenser unit 112 that receives the bast fiber stream 102 and expels excess air from the pneumatically conveyed stream 102 to produce a condensed mass of bast fiber material. The condenser unit 112 may also feed the material of the bast fiber stream 102 to the downstream unit operation at a constant feed rate. Each of FIGS. 5-9 show a condenser unit 112 upstream of each respective unit operation. Each of these condenser units 112 is preferably identical to each of the other units 112.

Figure 11:
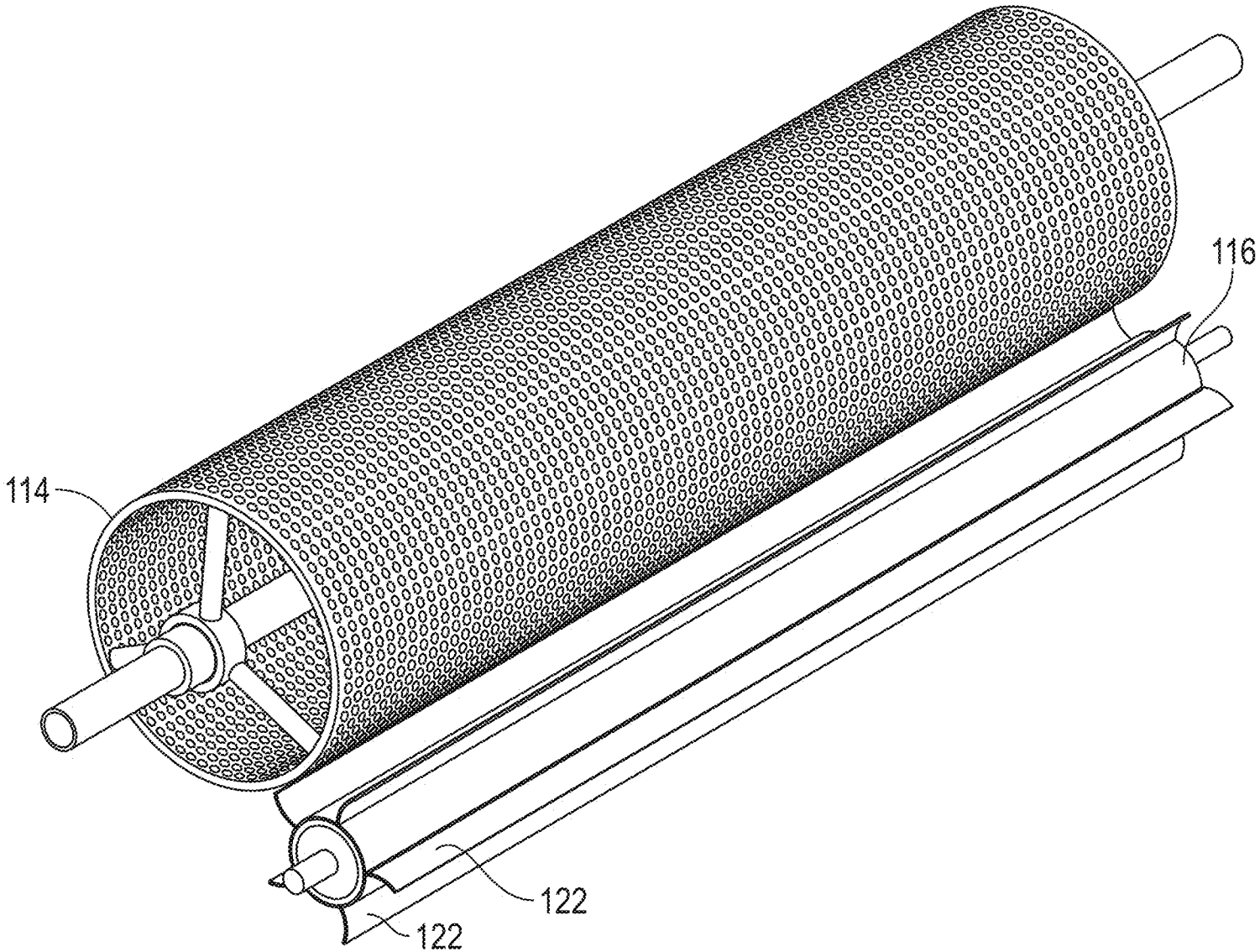
FIG. 11 shows a perspective view of components of a system for condensing bast fibers in accordance with the present disclosure.

In a preferred embodiment, each condenser unit 112 comprises a condensing drum 114 and a feed roller 116. The condensing drum 114 is designed to remove air from the bast fiber stream 102, and the feed roller 116 is designed to feed bast fibers from the condenser unit 112 to the next downstream unit operation. Each of the condensing drum 114 and the feed roller 116 rotates about a respective axis of rotation with the two axes of rotation being parallel to each other. As viewed from the perspective shown in each of FIGS. 5-9, both the condensing drum 114 and the feed roller 116 rotate in a clockwise direction. Each condenser unit 112 also comprises a suction blower 118 configured to expel air from the pneumatically conveyed bast fiber stream 102. FIG. 11 illustrates both the condensing drum 114 and the feed roller 116 removed from the condenser unit 112. The condensing drum 114 comprises a cylindrical drum having an outer wall surrounding a hollow interior. The outer wall has a plurality of openings extending through the outer wall so that the hollow interior of the drum 114 is in fluid communication with an exterior of the drum 114 through the openings. The openings in the hollow drum 114 are sized so that the bast fibers contained in the bast fiber stream 102 generally do not pass through the openings. The suction blower 118 is configured to create a partial vacuum within the hollow interior of the drum 114 so that excess air in the bast fiber stream 102 is removed from the stream 102 by drawing the air into the hollow interior of the drum 114 through the plurality of openings in the wall of the drum 114. The suction blower 118 then discharges an air stream 120 from the condenser unit 112 to remove the excess air from the bast fiber stream 102. The excess air stream 120 may be routed to a filter to remove particulate matter, dust, debris, small amounts of bast fibers, or any other small contaminants from the air stream 120 before the excess air is discharged to the environment. The suction created by the suction blower 118 may cause at least a portion of the bast fibers to be drawn against the outer surface of the wall of the condensing drum 114. In a preferred embodiment, each condensing unit 112 has an interior wall 124 having a portion that has a shape that conforms to the shape of the condensing drum 114. The portion of the interior wall 124 is disposed in a position relative to the condensing drum 114 so that there is only a very small clearance between the portion of the interior wall 124 and the condensing drum 114 as the drum 114 rotates, which causes the bast fibers drawn against the condensing drum 114 to be pulled off of the exterior surface of the drum 114.

In a preferred embodiment, the feed roller 116 has a plurality of flexible flaps 122 attached to the feed roller 116 and extending radially outward from the feed roller 116, as best seen in FIG. 11. Each of the flaps 122 is attached to the feed roller 116 along a longitudinal length of the roller 116 so that each flap 122 is generally parallel to each of the other flaps 122 and to the axis of rotation of the feed roller 116. Each of the flaps 122 is preferably constructed of a rubber material that is deformable so that the flap 122 is generally flexible but returns to its original shape and position when a flexing force is removed from the flap 122. Thus, each flap 122 is flexible but retains a position in which the flap 122 extends radially outward from the feed roller 116. In a preferred embodiment, the feed roller 116 is positioned relative to the condensing drum 114 and the interior wall 124 of the condenser unit 112 so that the flexible flaps 122 of the feed roller 116 contact portions of the interior wall 124 surrounding the feed roller 116 and a portion of the exterior of the condensing drum 114 at the location where the interior wall 124 pulls bast fibers off of the exterior of the condensing drum 114. In a preferred embodiment, as illustrated in FIG. 5, portions of the interior wall 124 are disposed on opposing sides of the feed roller 116 so that the bast fibers are fed to the feed roller 116 on an inlet side of the feed roller 116 that is adjacent to the condensing drum 114 and are discharged from the feed roller 116 on an outlet side of the feed roller 116 that is on an opposite side of the feed roller 116 from the condensing drum 114. The flexible flaps 122 preferably contact the interior wall 124 on both sides of the feed roller 116 as the feed roller 116 rotates. Thus, as the feed roller 116 rotates, the plurality of flaps 122 pulls the bast fibers contained in the bast fiber stream 102 off of the condensing drum 114 and off of portions of the interior wall 124 adjacent to the condensing drum 114 and transfers the bast fibers from the inlet side of the feed roller 116 to the outlet side of the feed roller 116, at which point the bast fibers are discharged from the condenser unit 112 with excess air from blowers used for pneumatic conveyance removed from the bast fiber stream 102. In a preferred embodiment, as shown in FIG. 5, the feed roller 116 discharges the bast fibers downward into a vertical conduit, and the bast fibers are deposited onto a conveyor 514 that transfers the bast fibers to the coarse cleaner assembly 500 downstream of the shredder assembly 400.

The coarse cleaner assembly 500 comprises a rotating drum 502 configured to rotate about an axis of rotation 506 and a bed 508 disposed below the rotating drum 502. As viewed from the perspective shown in FIG. 5, the rotating drum 502 rotates in a counterclockwise direction. The coarse cleaner assembly 500 may comprise a pair of opposing feed rollers 516 designed to transfer the bast fibers of the bast fiber stream 102 from conveyor 514 to the rotating drum 502. At least a portion of the bed 508 disposed below the rotating drum 502 has a plurality of bed openings 512 extending through the bed 508. The rotating drum 502 comprises a plurality of beater bars 504 extending radially outward from an outer surface of the rotating drum 502. At least a portion of the bed 508 defines a generally curved shape that generally conforms to a curved path of the distal ends of the beater bars 504 as the rotating drum 502 rotates. The bed 508 is disposed below the rotating drum 502 in a position so that there is only a relatively small clearance between the distal ends of the beater bars 504 of the rotating drum 502 and an interior surface of the bed 508 as the drum 114 rotates. In a preferred embodiment, there is a clearance of about 0.5-2.0 inches, and preferably about one (1) inch, between the upper surface of the bed 508 and the distal ends of the beater bars 504 as the drum 502 rotates. The rotating drum 502 is configured such that the plurality of beater bars 504 contacts the bast fibers on the bed 508 when the rotating drum 502 rotates, thereby causing larger impurities to separate from the bast fibers. When these larger impurities are physically separated from the bast fibers, this waste material falls through the plurality of bed openings 512 in the bed 508. The coarse cleaner assembly 500 may be utilized to remove any type of waste material in the bast fiber stream 102, which may include amounts of smaller impurities in addition to larger impurities, through the coarse cleaner assembly 500 is primarily designed for the removal of larger impurities.

Figure 12:
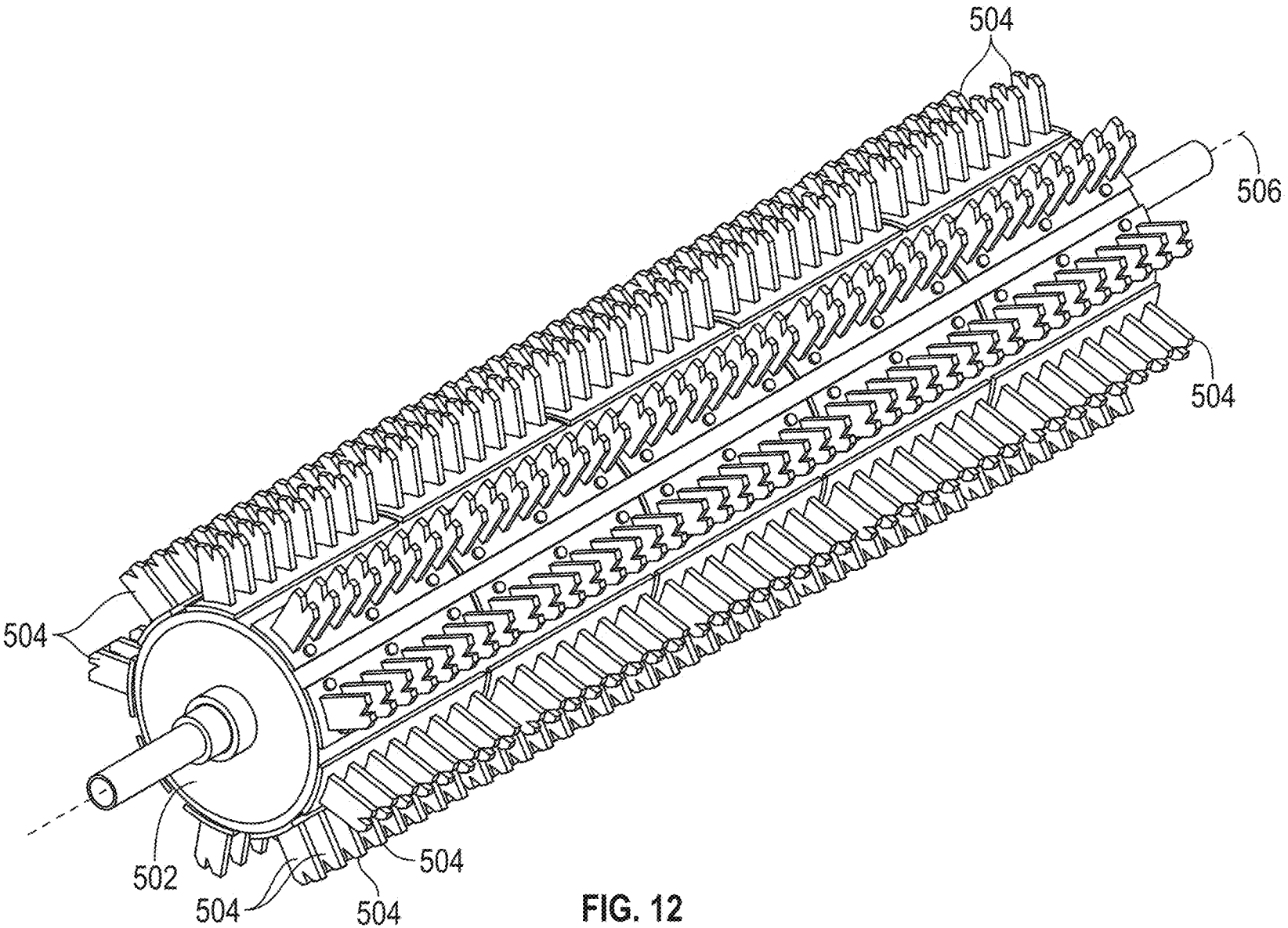
FIG. 12 shows a perspective view of components of a system for cleaning bast fibers in accordance with the present disclosure.

FIG. 12 illustrates the rotating drum 502 with attached beater bars 504 removed from the coarse cleaner assembly 500. In a preferred embodiment, the rotating drum 502 has 250 to 300 individual beater bars 504 arranged in rows along a longitudinal length of the rotating drum 502 and extending outwardly from the drum 502. In one preferred embodiment, each of the beater bars 504 has a length of about 80 mm to 85 mm extending from the outer surface of the drum 502 to the distal end of the beater bar 504. In one embodiment, each of the beater bars 504 has a depth of about 30 mm to 35 mm in a direction parallel to the direction of rotation and a width of at least 8 mm in an axial direction parallel to the axis of rotation 506. Preferably, each beater bar 504 is about 30 mm to 35 mm apart from each adjacent beater bar 504 in each row of beater bars 504. Alternatively, each of the beater bars 504 may have different sizes and spacing. In a preferred embodiment, the distal end of each beater bar 504, as well as all other outer surfaces of each beater bar 504, has a blunt end that is not sharpened and does not generally terminate with a sharply pointed edge or point. The beater bars 504 are generally designed to beat the bast fibers to mechanically remove waste from the stream 102 and not to cut or reduce the size of the fibers. In another preferred embodiment, the distal end of each beater bar 504 has an irregularly shaped end, as best seen in FIG. 12. Each bar 504 preferably has a generally rectangular shape with flat sides on all four sides of the bar 504 as the bar 504 extends radially outward from the outer surface of the rotating drum 502. In a preferred embodiment, a leading edge of the distal end of each beater bar 504 in the direction of rotation has a generally squared shape with a leading portion of the distal end disposed at a generally right angle to sides of the beater bar 504. In a preferred embodiment, the distal end of each beater bar 504 also has a notched area on a trailing side of the squared leading portion with the notched area extending across the width of the bar 504 in an axial direction parallel to the axis of rotation 506. The distal end of each bar 504 may have a sloped surface extending inwardly toward a base of the bar 504 to define the notched area. In a preferred embodiment, a trailing end of each bar 504 may have a second sloped surface that also extends inwardly and toward the trailing end of the bar 504.

In a preferred embodiment, each of the plurality of bed openings 512 in the bed 508 has a width that is adjustable in size. In this embodiment, at least a portion of the bed 508 preferably comprises a plurality of elongated bars 510 arranged in parallel to each other. Each of the elongated bars 510 extends in an axial direction that is parallel to the axis of rotation 506 to form at least a portion of the bed 508. Each of the plurality of bars 510 may have a generally squared shape with an inwardly facing surface that collectively define a surface of the bed 508. In a preferred embodiment, each of the bars 510 may be approximately 4 feet in length. FIG. 5 shows distal ends of each of the plurality of elongated bars 510 disposed adjacent to each other so that each of the bed openings 512 is defined by a space between adjacent bars 510. Thus, in this embodiment, each of the bed openings 512 preferably extends along a longitudinal length of adjacent elongated bars 510 in an axial direction parallel to the axis of rotation 506. In this case, the width of each of the bed openings 512 is defined by the distance between adjacent bars 510. The width of each of the bed openings 512 may be adjusted by adjusting the spacing between one or more of the plurality of elongated bars 510. In a preferred embodiment, the bed 508 of the coarse cleaner assembly 500 may be configured to allow the removal of excess bars 510 and the installation of additional bars 510 to achieve a desired width of the bed openings 512 throughout the flow path of the bast fiber stream 102 along the entire bed 508. In one embodiment, the width of the bed openings 512 may be adjusted independently of the width of other bed openings 512. In another embodiment, one or more of the plurality of elongated bars 510 may be replaced by other bars 510 having a different bar 510 width so that the spacing between adjacent bed openings 512 may be adjusted utilizing different bars 510 having a different width along the flow direction, which is generally transverse to the longitudinal length of each bar 510. Any suitable mechanism for retaining each of the elongated bars 510 in a fixed position relative to adjacent bars 510 and relative to the rotating drum 502 may be utilized.

By adjusting the width of the bed openings 512 of bed 508, a mass of larger impurities and waste material that fall through the plurality of bed openings 512 may be controlled. Generally, the greater the number of bed openings 512 and the greater the width of the bed openings 512, the greater the mass of waste material that will drop out of the bast fiber stream 102 through the bed openings 512 when the beater bars 504 forcibly contact the bast fibers as the drum 502 rotates. However, a portion of valuable bast fibers may also drop out of the bast fiber stream 102 through the bed openings 512 with the waste material. Depending on the waste content of the bast fiber stream 102 being processed at a given time, the width and/or quantity of bed openings 512 may be increased to maximize waste removal or decreased to minimize bast fiber loss. Ideally, the width and/or quantity of bed openings 512 is increased to an extent to which waste removal from the stream 102 is maximized while bast fiber loss is kept within an acceptable level. The coarse cleaner assembly 500 preferably includes a conveyor 518 disposed directly below the bed openings 512 so that the waste material is deposited directly onto the conveyor 518 as the waste material falls through the bed openings 512. The conveyor 518 may convey a waste stream 520 from the coarse cleaner assembly 500 to a disposal location. The bast fiber stream 102 may then be pneumatically conveyed through conduit 522 from the coarse cleaner assembly 500 to the next unit operation.

The bast fiber stream 102 may then be routed to a fine cleaner assembly 600 designed to remove smaller impurities and waste material. The bast fiber stream 102 may first pass through a condenser unit 112 to expel excess air from the stream 102 that is pneumatically conveyed from the coarse cleaner assembly 500 to produce a condensed mass of bast fiber material that then enters the fine cleaner assembly 600. As shown in FIG. 6, the fine cleaner assembly 600 comprises a cleaning roller 602 configured to rotate about an axis of rotation 620 and having a plurality of teeth extending radially outward from the cleaning roller 602. The cleaning roller 602 is configured such that the plurality of teeth contacts the bast fibers contained in the bast fiber stream 102 when the cleaning roller 602 rotates, thereby causing smaller impurities to separate from the bast fibers and fall out of the bast fiber stream 102.

After exiting the condenser unit 112, the bast fibers may be deposited onto a conveyor 610 that feeds the bast fiber stream 102 to the cleaning roller 602. The assembly 600 may include one or more pressure rollers 606 disposed above the conveyor 610 and configured to press and flatten the mass of bast fibers against an upper surface of the conveyor 610. The assembly 600 preferably also includes a pair of feed rollers 608, including an upper feed roller and a lower feed roller, disposed at a downstream end of the conveyor 610 and configured to feed the bast fibers to the cleaning roller 602. In a preferred embodiment, the upper feed roller 608 has a fluted outer surface, and the lower feed roller 608 has saw-tooth clothing of the type commonly used in carding machines. The fine cleaner assembly 600 preferably also comprises a transfer roller 604 disposed downstream of the cleaning roller 602 and a trash roller 605 disposed downstream of the transfer roller 604. Each of the cleaning roller 602, the transfer roller 604, and the trash roller 605 also has saw-tooth card clothing on an exterior surface of the roller. The transfer roller 604 preferably rotates in an opposite direction of the rotational direction of both the cleaning roller 602 and the trash roller 605 such that a majority of the bast fibers of the bast fiber stream 102 pass on a bottom side of the cleaning roller 602, then on a top side of the transfer roller 604 as the fibers are transferred to the trash roller 605, and then on a bottom side of the trash roller 605. From the perspective of the view shown in FIG. 6, the cleaning roller 602 and the trash roller 605 may rotate in a counterclockwise direction, and the transfer roller 604 may rotate in a clockwise direction.

Figure 13:
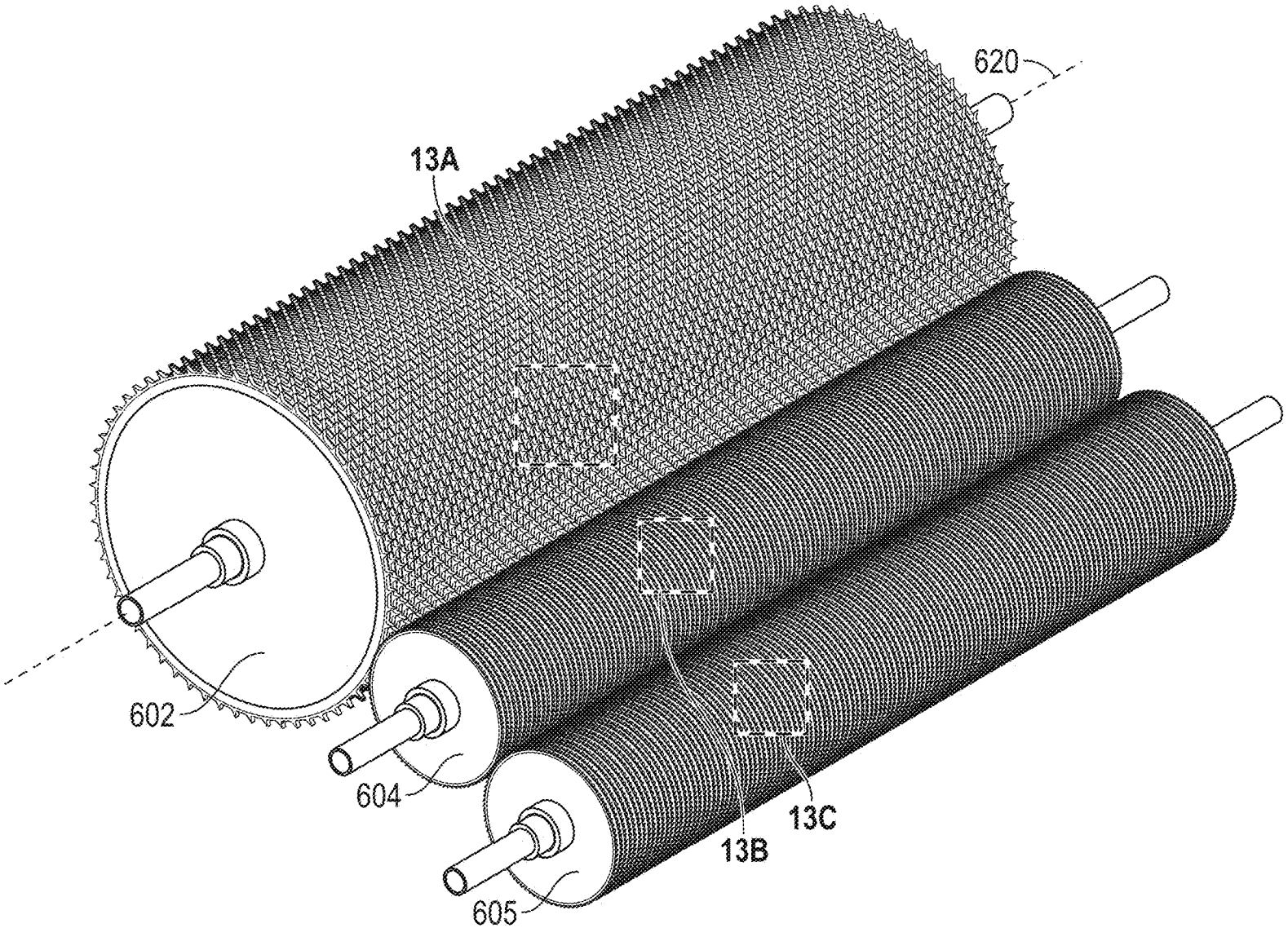
FIG. 13 shows a perspective view of components of a system for cleaning bast fibers in accordance with the present disclosure.
Figure 13A:
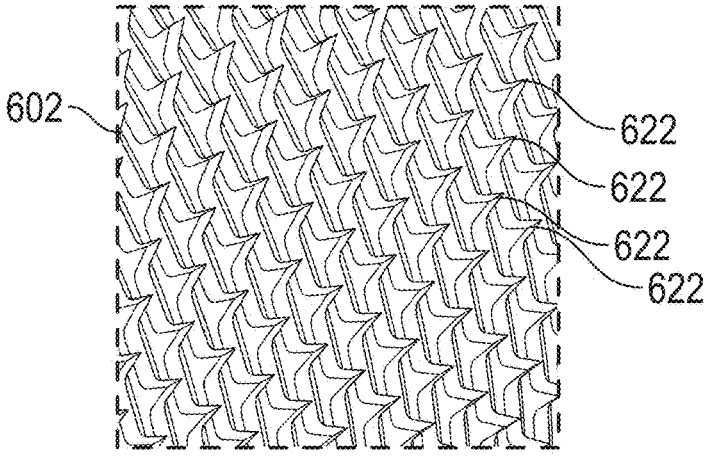
FIG. 13A shows a partial close-up view of a component of a system for cleaning bast fibers in accordance with the present disclosure.
Figure 13B:
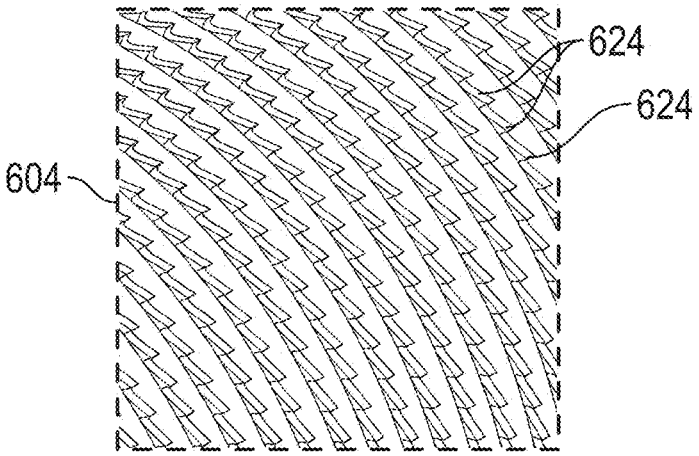
FIG. 13B shows a partial close-up view of a component of a system for cleaning bast fibers in accordance with the present disclosure.
Figure 13C:
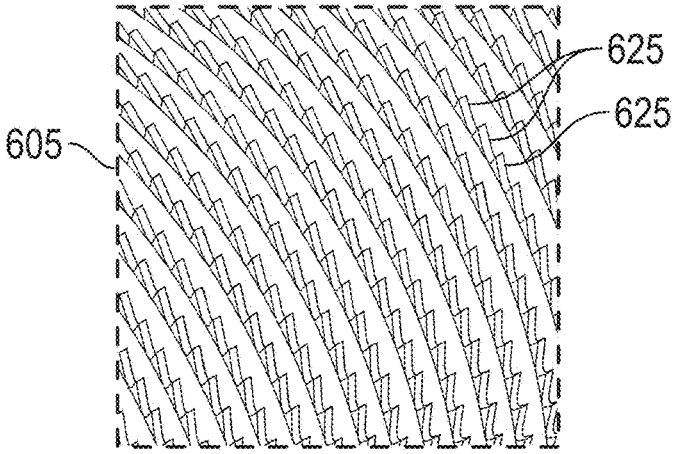
FIG. 13C shows a partial close-up view of a component of a system for cleaning bast fibers in accordance with the present disclosure.

FIG. 13 shows the cleaning roller 602, transfer roller 604, and trash roller 605 removed from the assembly 600 and shown in a perspective view showing the relative position of each of the rollers to each other. FIG. 13A shows a detailed view of the exterior of the cleaning roller 602, FIG. 13B shows a detailed view of the exterior of the transfer roller 604, and FIG. 13C shows a detailed view of the exterior of the trash roller 605. These views illustrate a preferred embodiment of each of the rollers 602, 604, and 605. As shown in FIGS. 13 and 13A, the exterior of the cleaning roller 602 preferably has card clothing of the type commonly used in carding machines disposed on the exterior of the roller 602 and having a saw-tooth arrangement comprising a plurality of teeth 622 disposed around substantially all of the exterior of the cleaning roller 602. As shown in FIGS. 13, 13B, and 13C, the exterior of the transfer roller 604 and trash roller 605 preferably also have card clothing disposed on the exterior of the rollers 604 and 605 and also having a saw-tooth arrangement comprising a plurality of teeth 624 and 625, respectively, disposed around substantially all of the exterior of the cleaning rollers 604 and 605, though teeth 624 and 625 preferably have a different shape than teeth 622.

Contact with the cleaning roller 602 may cause impurities and waste to separate from the bast fibers and fall out of the bast fiber stream 102 down onto a waste conveyor 612, which may convey a waste stream 614 that is discharged from the fine cleaner assembly 600. In a preferred embodiment, as shown in FIG. 1A, the waste stream 614 may optionally be routed to a second fine cleaner assembly 700. The waste stream 614 may include some bast fibers, which may be recovered in the second fine cleaner assembly 700. Alternatively, waste stream 614 may be discarded.

In a preferred embodiment, the teeth 622 of the cleaning roller 602 are asymmetrical and preferably each have a pointed tip with a generally flat edge leading to the tip on one side of the tip and a sloped edge on the opposing side of the tip. The flat edge is generally vertical in a radial direction relative to the axis of rotation 620 and is at the leading edge of each tooth 622 in the direction of rotation. In a preferred embodiment, each of the transfer roller 604 and trash roller 605 also has asymmetrical teeth 624 and 625, respectively. Preferably, as shown in FIGS. 13B and 13C, the teeth 624 of the transfer roller 604 have pointed tips that point in an opposite rotation direction relative to the pointed tips of the teeth 625 of the trash roller 605 so that the tips of teeth 624 and 625 are at the leading edge of each of teeth 624 and 625 in the direction of rotation of the transfer roller 604 and trash roller 605, respectively. As the transfer roller 604 rotates in the opposite direction of the cleaning roller 602, the teeth 624 of the transfer roller 604 transfer the bast fibers of the bast fiber stream 102 to the trash roller 605. The trash roller 605 is the final step of waste removal from the bast fiber stream 102 in the fine cleaner assembly. The trash roller 605 transfers the bast fiber stream 102 to a discharge location. A blower 616 may then remove bast fibers from the trash roller 605 and pneumatically convey the bast fiber stream 102 to a discharge conduit 618.

As shown in FIG. 7, the waste stream 614 from the first fine cleaner assembly 600 may be routed through a condenser unit 112 to expel excess air from the stream 614 that is pneumatically conveyed from the first fine cleaner assembly 600 to produce a condensed mass of bast fiber material contained within the waste stream 614 that then enters the second fine cleaner assembly 700. The second fine cleaner assembly 700 preferably comprises many of the same components as the first fine cleaner assembly 600, including a cleaning roller 602, a transfer roller 604, and a trash roller 605, each preferably having the same dimensions, positioning relative to each other, and configuration of card clothing with teeth as their counterpart components in the first fine cleaner assembly 600. Other components such as the feed conveyor 610, feed rollers 608, and blower 616 are preferably also the same. The second fine cleaner assembly 700 generally processes a smaller mass of bast fiber as the first fine cleaner assembly 600 and is also generally designed to remove smaller impurities and waste material from the stream 614. In a preferred embodiment, as shown in FIG. 7, the second fine cleaner assembly 700 further comprises a lower enclosure structure 702 disposed below all of the rollers 602, 604, and 605. The structure 702 is preferably shaped to conform to the curvature of each of the rollers 602, 604, and 605. In a preferred embodiment, the clearance between the enclosure structure 702 and the distal ends of the teeth of the cleaning roller 602, transfer roller 604, and trash roller 605 is about 0.025-0.075 inches. In one preferred embodiment, the clearance is about 0.044 inches. The structure 702 preferably includes a plurality of mote knife assemblies 704 each including a suction hood configured to extract waste material by suction. In a preferred embodiment, the structure 702 directly below the cleaning roller 602 includes two mote knife assemblies 704, and the structure 702 below the trash roller 605 includes one mote knife assembly 704, as shown in FIG. 7. Each mote knife assembly 704 comprises a sharp edge disposed below roller 602 or 605 and extending transversely to the direction of rotation of the roller 602, 605 and thus the direction of conveyance of the stream 614 being processed. The edge of the mote knife assembly 704 is configured to further remove waste material or other contaminants from the waste stream 614 as the corresponding roller 602, 605 rotates, thereby causing the material of the waste stream 614 to contact the edge of the assembly 702. The clearance between the edge of each mote knife assembly 702 and its respective roller 602 or 605 may be adjusted so that the edge removes very little, if any, bast fibers to minimize bast fiber losses. In one embodiment, the mote knife assembly 704 below the cleaning roller 602 may be designed to primarily remove plant matter and larger particulate matter, and the mote knife assembly 704 below the trash roller 605 may be designed to primarily remove trash and dust. Each mote knife assembly 704 has a suction hood in the form of a tube disposed adjacent to the edge and also extending transversely to the direction of rotation of the roller 602, 605. When waste material is removed from the stream 614, the material is extracted into the tubes by suction. The extracted material from each of the mote knife assemblies 704 may be combined into a separate waste stream 706 that may be discarded. A recycled product stream 615 comprising bast fibers that have been processed through the second fine cleaner assembly 700 may be pneumatically conveyed by a blower 616 through a conduit 618. As shown in FIG. 1A, the recycled product stream 615 may be routed back to and combined with the bast fiber stream 102 that is discharged from the first fine cleaner assembly 600 to form a combined bast fiber stream 102.

Figure 8:
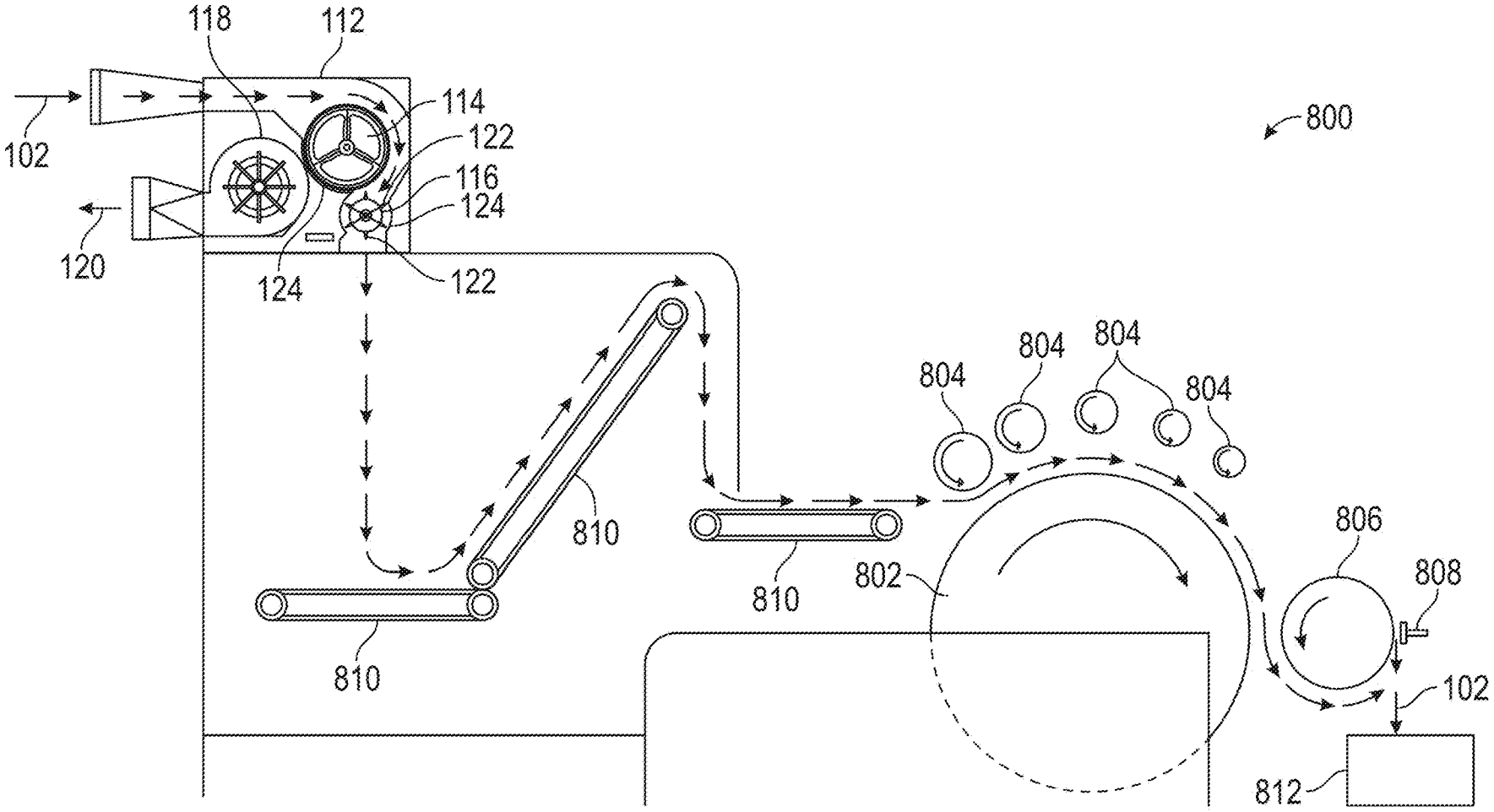
FIG. 8 shows a schematic diagram of a system for processing bast fibers through a carding machine in accordance with the present disclosure.

After processing the bast fiber stream 102 through the coarse cleaner assembly 500 and fine cleaner assemblies 600 and 700, the stream 102 is then routed through a carding machine 800 downstream of the fine cleaner assemblies 600 and 700. The bast fiber stream 102 may first pass through a condenser unit 112 to expel excess air from the combined bast fiber stream 102 that is pneumatically conveyed from the fine cleaner assemblies 600 and 700 to produce a condensed mass of bast fiber material that then enters the carding machine 800. FIG. 8 shows a schematic diagram of an example carding machine 800 that may be utilized, including a condenser unit 112. The carding machine 800 may include one or more conveyors 810 configured to receive the bast fiber stream 102 from the condenser unit 112 and transfer the bast fiber stream 102 to the carding machine 800 for refining. The carding machine 800 comprises a carding drum 802 and at least one working roller 804 and preferably five or more working rollers 804. The carding machine 800 further refines and finishes the bast fiber stream 102 to produce the final bast fiber product by further reducing any entangled masses of bast fibers into a filmy web by working the fibers of the bast fiber stream 102 between closely spaced and differentially moving surfaces of the carding drum 802 and working rollers 804. Both the main carding drum 802 and each of the working rollers 804 has an exterior surface on which card clothing is installed. The card clothing is generally a firm flexible material that is embedded with sharp wire points or metal pins that function as teeth. Each of the working rollers 804 may have different sized teeth designed to orient the bast fibers in a longitudinal and parallel orientation. The working rollers 804 may also rotate at different speeds and at a different speed than the main carding drum 802. The carding machine 800 may also include at least one doffing roller 806 that is configured to comb and remove bast fibers from the main carding drum 802 on which the bast fibers have been straightened and aligned. The doffing roller 806 is set with pins that hold the bast fiber to remove the fiber from the carding drum 802 as the carding drum 802 and doffing roller 806 rotate in opposite rotational directions. The bast fibers may then be removed by a vibrating comb bar 808 that is disposed directly adjacent to an outer surface of the doffing roller 806 so that the bar 808 pulls the bast fibers off of the doffing roller 806 as the bar 808 vibrates adjacent to the rotating doffing roller 806. As the comb bar 808 removes the bast fibers, the finished bast fiber product may be fed into a hopper 812. In one embodiment, the carding machine 800 may be a Garnett card machine or any other commercially available carding machine suitable for opening fibers and for disentangling, cleaning, and aligning the fibers. FIG. 8 shows one example carding machine 800 that may be utilized.

Figure 9:
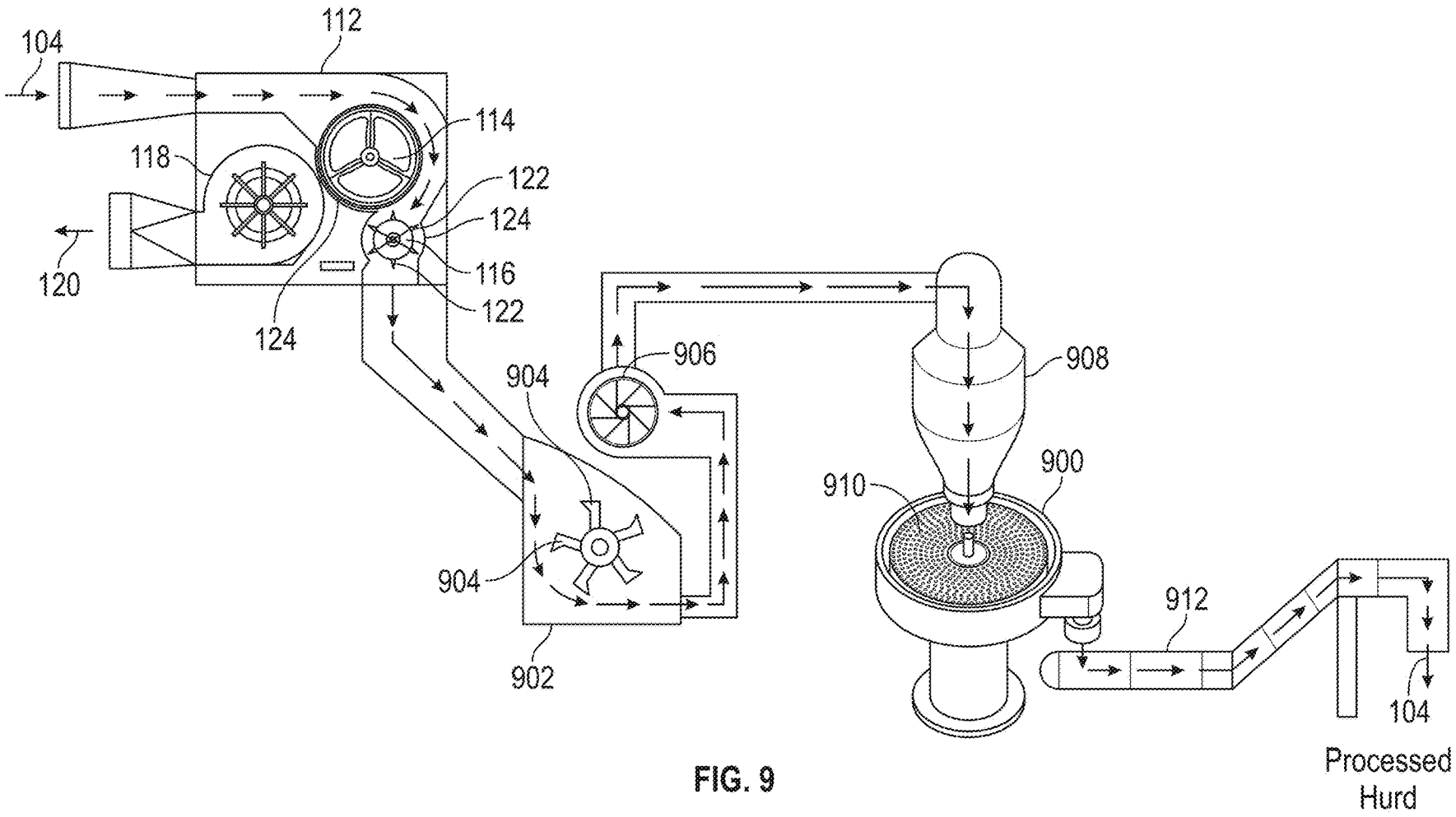
FIG. 9 shows a schematic diagram of a system for processing hurd fibers in accordance with the present disclosure.

The hurd fiber stream 104 may be processed separately from the bast fiber stream 102, as shown in FIGS. 1B and 9. After the shaker table assembly 200 separates the combined stream 110 into the bast fiber stream 102 and the hurd stream 104, the hurd stream 104 may first pass through a condenser unit 112 to expel excess air from the hurd stream 104 that is pneumatically conveyed from the shaker table assembly 200 to produce a condensed mass of hurd material. The hurd stream 104 may then be routed to a hurd processing unit downstream of the shaker table assembly 200 and configured to receive the hurd stream 104. The hurd processing unit comprises a vibrating sieve assembly 900 configured to separate the hurd from impurities contained in the hurd stream 104 and optionally to sort the hurd material according to size. In a preferred embodiment, the hurd stream 104 is first routed to a hammer mill 902 after being discharged from the condenser unit 112. The hammer mill 902 comprises a rotating shaft having a plurality of hammers 904 attached to the shaft and extending radially outward from the shaft. As the shaft rotates, the hammers 904 reduce the size of the hurd material as the hammers 904 strike the hurd. In a preferred embodiment, the hammer mill 902 is designed to size the individual pieces of hurd material to an average size of approximately ¾ inches in length. The sized hurd stream 104 may then be conveyed to the sieve assembly 900 downstream of the hammer mill 902 by a blower 906 via conduit. The conduit may be connected to a spiraled container 908 arranged to that the hurd stream 104 may enter the container 908 in a spiraling flow and then be deposited onto a vibrating sieve plate 910 having a plurality of openings. In a preferred embodiment, the sieve assembly 900 may be a multi-stage sieve with multiple sieve plates 910 having openings of different sizes. The one or more sieve plates 910 are designed to sift out dust, dirt, debris, or any other waste material, including any bast fibers in the hurd stream 104. The sieve 900 may also be used to sort the hurd material into different sizes. The sieve assembly 900 may also include a discharge conveyor 912 configured to convey the finished, fully processed hurd stream 104 to a discharge location.

The present system 100 and method are capable of producing finished bast fiber 102 and hurd streams 104 from which 99% of all impurities have been removed. Typically, bast fibers are only processed through a carding machine. By utilizing a series of unit operations as disclosed herein prior to processing the fibers through a carding machine, a superior bast fiber product may be produced. Further, the present system 100 and method are capable of producing bast fiber and hurd that are properly sized for yarn spinning of woven fabrics, such as wool or cotton, or nonwoven fabrics. All of the unit operations and steps performed in the present method are entirely mechanical in nature and do not involve any chemical additions or chemical alterations of the bast or hurd material.

It will be appreciated that the configurations and methods shown and described herein are illustrative only, and that these specific examples are not to be considered in a limiting sense, because numerous variations are possible. The subject matter of the present disclosure includes all novel and non-obvious combinations and sub-combinations of the various systems and configurations, and other features, functions, and/or properties disclosed herein. It is understood that versions of the invention may come in different forms and embodiments. Additionally, it is understood that one of skill in the art would appreciate these various forms and embodiments as falling within the scope of the invention as disclosed herein.

What is claimed is:

1. A method of processing plant fibers, said method comprising the steps of:

decorticating plant stalks to separate bast fibers from hurd;

then separating the bast fibers and the hurd into separate process streams comprising a bast fiber stream and a hurd stream;

then routing the bast fiber stream to a chopper assembly, wherein the chopper assembly is configured to cut the bast fibers using a blade to reduce an average length of the bast fibers;

then routing the bast fiber stream to a shredder assembly, wherein the shredder assembly comprises a feed roller, a shredding roller, and a first bed disposed below the shredding roller, wherein the feed roller is configured to feed the bast fibers to the shredding roller, wherein the shredding roller is configured to rotate about an axis of rotation, wherein the shredding roller comprises a plurality of pins extending radially outward from an outer surface of the shredding roller, wherein each pin of the plurality of pins has a cylindrical body that tapers to a point at a distal end of the pin, wherein the cylindrical body of each pin is generally perpendicular to the axis of rotation of the shredding roller, wherein the pins of the shredding roller are configured to pull the bast fibers off of the feed roller as the shredding roller rotates, wherein the shredding roller is configured such that the plurality of pins contacts the bast fibers on the first bed when the shredding roller rotates, thereby combing the bast fibers and conveying the bast fibers along the first bed;

then routing the bast fiber stream to a coarse cleaner assembly, wherein the coarse cleaner assembly comprises a rotating drum and a second bed disposed below the rotating drum, wherein the second bed has a plurality of bed openings extending through the second bed, wherein the rotating drum is configured to rotate about an axis of rotation, wherein the rotating drum comprises a plurality of beater bars extending radially outward from the rotating drum, wherein the rotating drum is configured such that the plurality of beater bars contacts the bast fibers on the second bed when the rotating drum rotates, thereby causing larger impurities to separate from the bast fibers and fall through the plurality of bed openings in the second bed;

then routing the bast fiber stream to a fine cleaner assembly, wherein the fine cleaner assembly comprises a cleaning roller configured to rotate about an axis of rotation, wherein the cleaning roller comprises a plurality of teeth extending radially outward from the cleaning roller, wherein the cleaning roller is configured such that the plurality of teeth contacts the bast fibers when the cleaning roller rotates, thereby causing smaller impurities to separate from the bast fibers; and then routing the bast fiber stream through a carding machine comprising a carding drum and at least one working roller.

2. The method of claim 1, further comprising the step of routing the hurd stream to a hammer mill and then to a vibrating sieve configured to separate the hurd from impurities in the hurd stream.

3. The method of claim 1, wherein each of the plurality of bed openings in the second bed has a width that is adjustable in size, wherein the method further comprises the step of adjusting the width of one or more of the plurality of bed openings in the second bed to control a mass of the larger impurities that fall through the plurality of bed openings in the second bed.

4. The method of claim 3, wherein the second bed comprises a plurality of bars arranged in parallel to each other, wherein the step of adjusting the width of one or more of the plurality of bed openings in the second bed comprises adjusting a spacing between one or more of the plurality of bars.

5. The method of claim 1, wherein the step of separating the bast fibers and the hurd into separate process streams comprises routing the bast fibers and hurd to a vibrating screen, wherein the vibrating screen has a plurality of screen openings sized to allow a majority of the hurd to fall through the screen openings while a majority of the bast fibers do not fall through the screen openings.

6. The method of claim 1, wherein the chopper assembly comprises a conveyor configured to convey the bast fibers to a reciprocating blade disposed above an anvil.

7. A system for processing plant fibers, wherein the system comprises:

a chopper assembly configured to cut bast fibers using a blade to reduce an average length of the bast fibers;

a shredder assembly disposed downstream of the chopper assembly, wherein the shredder assembly comprises a feed roller, a shredding roller, and a first bed disposed below the shredding roller, wherein the feed roller is configured to feed the bast fibers to the shredding roller, wherein the shredding roller is configured to rotate about an axis of rotation, wherein the shredding roller comprises a plurality of pins extending radially outward from an outer surface of the shredding roller, wherein each pin of the plurality of pins has a cylindrical body that tapers to a point at a distal end of the pin, wherein the cylindrical body of each pin is generally perpendicular to the axis of rotation of the shredding roller, wherein the pins of the shredding roller are configured to pull the bast fibers off of the feed roller as the shredding roller rotates, wherein the shredding roller is configured such that the plurality of pins contacts the bast fibers on the first bed when the shredding roller rotates, thereby combing the bast fibers and conveying the bast fibers along the first bed;

a coarse cleaner assembly disposed downstream of the shredder assembly, wherein the coarse cleaner assembly comprises a rotating drum and a second bed disposed below the rotating drum, wherein the second bed has a plurality of bed openings extending through the second bed, wherein the rotating drum is configured to rotate about an axis of rotation, wherein the rotating drum comprises a plurality of beater bars extending radially outward from the rotating drum, wherein the rotating drum is configured such that the plurality of beater bars contacts the bast fibers on the second bed when the rotating drum rotates, thereby causing larger impurities to separate from the bast fibers and fall through the plurality of bed openings in the second bed;

a fine cleaner assembly disposed downstream of the coarse cleaner assembly, wherein the fine cleaner assembly comprises a cleaning roller configured to rotate about an axis of rotation, wherein the cleaning roller comprises a plurality of teeth extending radially outward from the cleaning roller, wherein the cleaning roller is configured such that the plurality of teeth contacts the bast fibers when the cleaning roller rotates, thereby causing smaller impurities to separate from the bast fibers; and a carding machine disposed downstream of the fine cleaner assembly, wherein the carding machine comprises a carding drum and at least one working roller.

8. The system of claim 7, further comprising a decorticator disposed upstream of the chopper assembly, wherein the decorticator is configured to decorticate plant stalks to separate bast fibers from hurd.

9. The system of claim 8, further comprising a vibrating screen, wherein the vibrating screen is disposed downstream of the decorticator and upstream of the chopper assembly, wherein the vibrating screen has a plurality of screen openings sized to allow a majority of the hurd to fall through the screen openings while a majority of the bast fibers do not fall through the screen openings, wherein the vibrating screen is configured to separate the bast fibers and the hurd into separate process streams comprising a bast fiber stream and a hurd stream.

10. The system of claim 9, further comprising a hurd processing unit disposed downstream of the vibrating screen and configured to receive the hurd stream, wherein the hurd processing unit comprises a hammer mill and a vibrating sieve disposed downstream of the hammer mill, wherein the hammer mill is configured to reduce a size of the hurd, and wherein the vibrating sieve is configured to separate the hurd from impurities in the hurd stream.

11. The system of claim 7, wherein each of the plurality of bed openings in the second bed has a width that is adjustable in size.

12. The system of claim 11, wherein the second bed comprises a plurality of bars arranged in parallel to each other, wherein the width of each of the plurality of bed openings in the second bed is defined by a spacing between adjacent bars of the plurality of bars, wherein the spacing between adjacent bars is adjustable.

13. The system of claim 7, wherein the chopper assembly comprises a conveyor configured to convey the bast fibers to a reciprocating blade disposed above an anvil.

14. The system of claim 7, wherein the fine cleaner assembly further comprises a transfer roller disposed downstream of the cleaning roller and a trash roller disposed downstream of the transfer roller, wherein the transfer roller is configured to rotate in an opposite direction of the rotational direction of both the cleaning roller and the trash roller, wherein the trash roller has saw-tooth wire clothing on an exterior of the trash roller, and wherein the trash roller is configured to remove remaining impurities from the bast fibers.

15. The system of claim 14, wherein the fine cleaner assembly further comprises a mote knife assembly comprising an edge disposed below the trash roller and a suction hood, wherein the edge and suction hood of the mote knife assembly are configured to remove the remaining impurities from the trash roller by suction.

16. The system of claim 7, wherein each pin of the plurality of pins has a height of about 7-8 millimeters (mm) from the outer surface of the shredding roller to the distal end of the pin, wherein the cylindrical body of each pin has a diameter of approximately 4 mm, and wherein each pin of the plurality of pins is approximately 6 mm apart from each adjacent pin.

17. The method of claim 1, wherein each pin of the plurality of pins has a height of about 7-8 millimeters (mm) from the outer surface of the shredding roller to the distal end of the pin, wherein the cylindrical body of each pin has a diameter of approximately 4 mm, and wherein each pin of the plurality of pins is approximately 6 mm apart from each adjacent pin.

* * * * *